US006386664B1

(12) United States Patent
Hosono et al.

(10) Patent No.: US 6,386,664 B1
(45) Date of Patent: May 14, 2002

(54) INK-JET RECORDING APPARATUS

(75) Inventors: Satoru Hosono; Kaoru Momose, both of Nagano-Ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/493,092

(22) Filed: Jan. 28, 2000

(30) Foreign Application Priority Data

Jan. 29, 1999 (JP) ..... 11-023297
Jan. 14, 2000 (JP) ..... 2000-007054

(51) Int. Cl.[7] ..... B41J 29/38
(52) U.S. Cl. ..... 347/9; 347/10; 347/11
(58) Field of Search ..... 347/9, 10, 11

(56) References Cited

FOREIGN PATENT DOCUMENTS

| | | | |
|---|---|---|---|
| EP | 0 782 924 A2 | 7/1997 | ..... B41J/2/045 |
| EP | 0 788 882 | 8/1997 | ..... B41J/2/04 |
| EP | 0 829 354 | 3/1998 | ..... B41J/2/045 |
| JP | 54(1979)-17731 | 2/1979 | ..... B41J/3/04 |
| JP | 57(1982)-61576 | 4/1982 | ..... B41J/3/04 |

OTHER PUBLICATIONS

JPO Abstract 57(1982)–61576, Apr. 14, 1982.
JPO Abstract 54(1979)–17731, Feb. 9, 1979.

*Primary Examiner*—John Barlow
*Assistant Examiner*—Alfred Dudding

(74) *Attorney, Agent, or Firm*—Wenderoth, Lind & Ponack, L.L.P.

(57) ABSTRACT

An ink-jet recording apparatus includes a recording head having a nozzle, and a micro-vibrating unit for causing ink in the nozzle to minutely vibrate. A recording-starting-position setting unit sets recording-starting-position information that represents a position where the nozzle should start to jet the ink, according to recording data. A micro-vibrating-starting-position setting unit sets micro-vibrating-starting-position information that represents a position where the micro-vibrating unit should start to cause the ink to minutely vibrate, according to the recording-starting-position information. A scanning-position-information outputting unit outputs head-position information that represents a position of the recording had while the recording head is scanning. A pre-recording micro-vibrating controlling unit judges a micro-vibrating-starting timing according to the micro-vibrating-starting-position information and the head-position information in order to cause the micro-vibrating unit to operate. According to the above ink-jet recording apparatus, a meniscus of the ink in the nozzle may be caused to minutely vibrate for a predetermined time from a suitable timing (micro-vibrating-starting timing) just before an ink drop is jetted from the nozzle. Thus, the viscosity of the ink in the nozzle may be returned at a normal level just before the ink drop is jetted.

57 Claims, 11 Drawing Sheets

INK-JET RECORDING APPARATUS

FIELD OF THE INVENTION

This invention relates to an ink-jet recording apparatus having an ink-jet recording head capable of jetting ink from nozzles to a recording medium according to recording data. In particular, this invention relates to an ink-jet apparatus which can prevent viscosity of ink in nozzles from increasing.

BACKGROUND OF THE INVENTION

An ink-jet recording apparatus such as an ink-jet printer or an ink-jet plotter has a recording head that is movable in a main scanning direction. The recording head has nozzles capable of jetting ink. For example, the nozzles are communicated to pressure chambers which can expand and contract respectively. In the case, the ink in the nozzles can be jetted by expanding and contracting of the pressure chambers. The ink-jet recording apparatus is also adapted to feed a recording medium such as a recording paper in a subordinate scanning direction, which is perpendicular to the main scanning direction. Thus, the nozzles of the recording head can jet ink in order to from an image (or a character) on the recording medium in cooperation with moving the recording head and the recording medium according to recording data.

The ink in the nozzles of the recording head is exposed to air. Thus, solvent of the ink such as water may gradually evaporate to increase a viscosity of the ink in the nozzles. In the case, quality of the printed (recorded) image may deteriorate because the ink having a great viscosity maybe jetted in a direction deviated from a normal direction.

To prevent the viscosity of the ink in the nozzles from increasing, some measures have been proposed. One of the measures is to cause a meniscus of the ink to minutely vibrate in order to stir the ink. The meniscus means a free surface of the ink exposed at an opening of a nozzle.

For the purpose of stirring the ink, the meniscus may be caused to vibrate i.e. move toward a jetting direction of the ink and toward a contracting direction opposed to the jetting direction by turns in such a manner that the ink may not be jetted. The vibration of the meniscus can be also carried out by expanding and contracting of a corresponding pressure chamber. Owing to the vibration of the meniscus, the ink at the opening of the nozzle may be stirred to prevent the viscosity of the ink from increasing.

The stirring of the ink may be carried out during a scanning operation including one or more recording operation. For example, the stirring may be carried out while a carriage carrying the recording head is being accelerated just after starting of a main scanning, or while a recording operation for a nozzle is being carried out. In the stirring while the carriage is being accelerated, a micro-vibrating operating signal for micro vibrating is supplied to the recording head to cause all menisci in the nozzles to minutely vibrate. In the stirring while the recording operation is being carried out, a pulse signal for micro vibrating is generated from a jetting operating signal for jetting ink, and the pulse signal is supplied to the recording head so that the ink in the other nozzles not in the other recording (jetting) operation may be stirred.

Recently, such a type of ink-jet recording apparatus is requested to more improve the quality of the printed image and to enlarge an area of the recording medium capable of being recorded in a width direction thereof.

Thus, a volume of ink jetted at a time has been made smaller to improve the quality of the printed image. For example, in the recent recording apparatus, ink of only 1 ng to 6 ng is jetted at a time to form a dot, while ink not less than 10 ng is jetted at a time to form a dot in the conventional recording apparatus. When the volume of ink jetted at a time is smaller, impression on a granular feature of the printed image may be improved, that is, the quality of the printed image may be improved.

However, at the same time, when the volume of ink jetted at a time is smaller, the viscosity of the ink in the nozzles is liable to increase. That is because the ink in the nozzles is used only little by little.

In the case, even when the stirring of the ink is carried out while the carriage is being accelerated, a first ink drop is liable to be jetted in a direction deviated from a normal direction. Consequently, the quality of the printed image may deteriorate.

Especially, when the area of the recording medium capable of being recorded in the width direction is enlarged, the time of scanning becomes longer. In the case, when a recording (jetting) operation starts at a position in the latter half of a line, the solvent of the ink is liable to evaporate more before the recording operation during the scanning operation. Consequently, the quality of the printed image may deteriorate worse, especially at the position where the recording operation has started.

SUMMARY OF THE INVENTION

The object of this invention is to solve the above problems, that is, to provide an ink-jet recording apparatus that can prevent viscosity of ink from increasing even when the volume of ink jetted at a time is smaller and even when an area of a recording medium capable of being recorded in a width direction thereof is enlarged.

In order to achieve the object, an ink-jet recording apparatus includes: a recording head having a nozzle; a micro-vibrating unit for causing ink in the nozzle to minutely vibrate; a recording-starting-position setting unit for setting recording-starting-position information that represents a position where the nozzle should start to jet the ink, according to recording data; a micro-vibrating-starting-position setting unit for setting micro-vibrating-starting-position information that represents a position where the micro-vibrating unit should start to cause the ink to minutely vibrate, according to the recording-starting-position information; a scanning-position-information outputting unit capable of outputting head-position information that represents a position of the recording head while the recording head is scanning; and a pre-recording micro-vibrating controlling unit for judging a micro-vibrating-starting timing according to the micro-vibrating-starting-position information and the head-position information in order to cause the micro-vibrating unit to operate.

According to the above feature, a meniscus of the ink in the nozzle may be caused to minutely vibrate for a predetermined time from a suitable timing (micro-vibrating-starting timing) just before an ink drop is jetted from the nozzle. Thus, the viscosity of the ink in the nozzle may be returned at a normal level just before the ink drop is jetted.

In order to achieve the object, another ink-jet recording apparatus includes: a recording head having a nozzle; a micro-vibrating unit for causing ink in the nozzle to minutely vibrate; a recording-starting-position setting unit for setting recording-starting-position information that represents a position where the nozzle should start to jet the ink, according to recording data; a micro-vibrating-ceasing-position setting unit for setting micro-vibrating-ceasing-position information that represents a position where the micro-vibrating unit should cease to cause the ink to minutely vibrate, according to the recording-starting-position information; a scanning-position-information outputting unit capable of outputting head-position information that represents a position of the recording head while the recording head is scanning; and a pre-recording micro-vibrating controlling unit for judging a micro-vibrating-ceasing timing according to the micro-vibrating-ceasing-position information and the head-position information in order to cause the micro-vibrating unit to stop.

According to the above feature, a meniscus of the ink in the nozzle may be caused to minutely vibrate till a suitable timing (micro-vibrating-ceasing timing) just before an ink drop is jetted from the nozzle. Thus, the viscosity of the ink in the nozzle may be kept at a normal level till the ink drop is jetted.

In order to achieve the object, another ink-jet recording apparatus includes: a recording head having a plurality of nozzles, the nozzles being classified into at least two classes; a micro-vibrating unit for causing ink in a nozzle or nozzles of a class to minutely vibrate; a printing-starting-position setting unit for setting recording-starting-position information that represents a position where the nozzle or the nozzles of the class should start to jet the ink, according to recording data; a micro-vibrating-starting-position setting unit for determining whether to cause the ink in the nozzle or the nozzles of the class to minutely vibrate according to the recording-starting-position information, said micro-vibrating-starting-position setting unit setting micro-vibrating-starting-position information that represents a position where the micro-vibrating unit should start to cause the ink in the nozzle or the nozzles of the class to minutely vibrate according to the recording-starting-position information if to cause the ink in the nozzle or the nozzles of the class to minutely vibrate is determined; a scanning-position-information outputting unit capable of outputting head-position information that represents a position of the recording head while the recording head is scanning; and a pre-recording micro-vibrating controlling unit for judging a micro-vibrating-starting timing for the nozzle or the nozzles of the class according to the micro-vibrating-starting-position information and the head-position information in order to cause the micro-vibrating unit to operate.

According to the above feature, a meniscus or menisci of the ink in the nozzle or the nozzles of the class may be caused to minutely vibrate for a predetermined time from a suitable timing (micro-vibrating-starting timing) just before an ink drop or ink drops are jetted from the nozzle or the nozzles of the class. Thus, the viscosity of the ink in the nozzle or the nozzles may be returned at an normal level just before the ink drop or the ink drops are jetted. In addition, the micro-vibrating operation may be carried out more efficiently, because to cause the ink in the nozzle or the nozzles of the class to minutely vibrate may be determined only when the nozzle or the nozzles of the class need a micro-vibrating operation.

In the case, preferably, the ink-jet recording apparatus may further include a micro-vibrating-ceasing-position setting unit for setting micro-vibrating-ceasing-position information that represents a position where the micro-vibrating unit should cease to cause the ink in the nozzle or the nozzles of the class to minutely vibrate, according to the recording-starting-position information. In the case, preferably, the pre-recording micro-vibrating controlling unit may be adapted to judge a micro-vibrating-ceasing timing for the nozzle or the nozzles of the class according to the micro-vibrating-ceasing-position information and the head position information in order to cause the micro-vibrating unit to stop.

For example, the class may be include a plurality of nozzles, and ink in the nozzles of the class may have a velocity of increasing viscosity. Alternatively, the class may include a plurality of nozzles, and ink in the nozzles of the class may have a color. Alternatively, the class may include a plurality of nozzles, and the nozzles of the class may be arranged in a row. Alternatively, the class may include only one nozzle.

Preferably, the scanning-position-information outputting unit may have: a linear encoder arranged along a main scanning direction of the recording head, provided with slits at minute intervals; and a slit detector movable along the main scanning direction together with the recording head, capable of detecting the slits.

Preferably, the scanning-position-information outputting unit may have a first-scanning-time timer for measuring a predetermined time from when the recording head has started scanning.

Preferably, the scanning-position-information outputting unit may have a second-scanning-time timer for measuring a predetermined time from when a speed of the recording head during a scanning thereof has become constant.

In addition, preferably, the ink-jet recording apparatus may further include a thermometry unit for measuring a temperature of a surrounding of the recording head. In the case, preferably, an operating voltage of the micro-vibrating unit can be changed according to the temperature measured by the thermometry unit.

In addition, preferably, the ink-jet recording apparatus may further include a not-recording micro-vibrating controlling unit for judging whether the recording head is being accelerated according to the head-position information in order to cause the micro-vibrating unit to operate.

In the case, preferably, a signal generated by the pre-recording micro-vibrating controlling unit to cause the micro-vibrating unit to operate may be identical with a signal generated by the not-recording micro-vibrating controlling unit to cause the micro-vibrating unit to operate.

In addition, preferably, the ink-jet recording apparatus may further include a mid-recording micro-vibrating controlling unit for causing the micro-vibrating unit to operate in such a manner that the micro-vibrating unit causes ink in a nozzle or nozzles not in a recording operation to minutely vibrate while at least another nozzle is in the recording operation.

In addition, this application includes methods for using an ink-jet recording apparatus to achieve the object.

A method for using an ink-jet recording apparatus including: a recording head having a nozzle; a micro-vibrating unit for causing ink in the nozzle to minutely vibrate; a recording-starting-position setting unit for setting printing-starting-position information that represents a position where the nozzle should start to jet the ink, according to recording data; a micro-vibrating-starting-position setting unit for setting micro-vibrating-starting-position information that represents a position where the micro-vibrating unit should start to cause the ink to minutely vibrate, according to the recording-starting-position information; a scanning-position-information outputting unit capable of outputting head-position information that represents a position of the recording head while the recording head is scanning; and a pre-recording micro-vibrating controlling unit for judging a micro-vibrating-starting timing according to the micro-vibrating-starting-position information and the head-position information in order to cause the micro-vibrating unit to operate; comprises: a step of setting the micro-vibrating-starting-position information that represents the position where the micro-vibrating unit should start to cause the ink to minutely vibrate, according to the recording-starting-position information set by the recording-starting-position setting unit; and a step of causing the micro-vibrating unit to operate by the pre-recording micro-vibrating controlling unit, according to the micro-vibrating-starting-position information and the head-position information.

Another method for using an ink-jet recording apparatus including: a recording head having a nozzle; a micro-vibrating unit for causing ink in the nozzle to minutely vibrate; a recording-starting-position setting unit for setting printing-starting-position information that represents a position where the nozzle should start to jet the ink, according to recording data; a micro-vibrating-ceasing-position setting unit for setting micro-vibrating-ceasing-position information that represents a position where the micro-vibrating unit should cease to cause the ink to minutely vibrate, according to the recording-starting-position information; a scanning-position-information outputting unit capable of outputting head-position information the represents a position of the recording head while the recording head is scanning; and a pre-recording micro-vibrating controlling unit for judging a micro-vibrating-ceasing timing according to the micro-vibrating-ceasing-position information and the head-position information in order to cause the micro-vibrating unit to stop; comprises: a step of setting the micro-vibrating-ceasing-position information that represents the position where the micro-vibrating unit should cease to cause the ink to minutely vibrate, according to the recording-starting-position information set by the recording-starting-position setting unit; and a step of causing the micro-vibrating unit to stop by the pre-recording micro-vibrating controlling unit, according to the micro-vibrating-ceasing-position information and the head-position information.

Another method for using an ink-jet recording apparatus including: a recording head having a plurality of nozzles, the nozzles being classified into at least two classes; a micro-vibrating unit for causing ink in a nozzle or nozzles of a class to minutely vibrate; a printing-starting-position setting unit for setting recording-starting-position information that represents a position where the nozzle or the nozzles of the class should start to jet the ink, according to recording data; a micro-vibrating-starting-position setting unit for determining whether to cause the ink in the nozzle or the nozzles of the class to minutely vibrate according to the recording-starting-position information, said micro-vibrating-starting-position setting unit setting micro-vibrating-starting-position information that represents a position where the micro-vibrating unit should start to cause the ink in the nozzle or the nozzles of the class to minutely vibrate according to the recording-starting-position information if to cause the ink in the nozzle or the nozzles of the class to minutely vibrate is determined; a scanning-position-information outputting unit capable of outputting head-position information that represents a position of the recording head while the recording head is scanning; and a pre-recording micro-vibrating controlling unit for judging a micro-vibrating-starting timing for the nozzle or the nozzles of the class according to the micro-vibrating-starting-position information and the head-position information in order to cause the micro-vibrating unit to operate; comprises: a step of determining whether to cause the ink in the nozzle or the nozzles of the class to minutely vibrate according to the recording-starting-position information set by the recording-starting-position setting unit, and of setting the micro-vibrating-starting-position information that represents the position where the micro-vibrating unit should start to cause the ink in the nozzle or the nozzles of the class to minute vibrate if to cause the ink in the nozzle or the nozzles of the class to minutely vibrate is determined; and a step of causing the micro-vibrating unit to operate by the pre-recording micro-vibrating controlling unit, according to the micro-vibrating-starting-position information and the head-position information.

Preferably, the ink-jet recording apparatus may further include a thermometry unit for measuring a temperature of a surrounding of the recording head, and the method may further include a step of changing an operating voltage of the micro-vibrating unit according to the temperature measured by the thermometry unit.

Preferably, the ink-jet recording apparatus may further include a not-recording micro-vibrating controlling unit for judging whether the recording head is being accelerated according to the head-position information in order to cause the micro-vibrating unit to operate.

In the case, preferably, a signal generated by the pre-recording micro-vibrating controlling unit to cause the micro-vibrating unit to operate may be identical with a signal generated by the not-recording micro-vibrating controlling unit to cause the micro-vibrating unit to operate.

Preferably, the method may further include a step of causing the micro-vibrating unit to operate in such a manner that the micro-vibrating unit causes ink in a nozzle or nozzles not in a recording operation to minutely vibrate while at least another nozzle is in the recording operation.

A computer can materialize: the recording-starting-position setting unit for setting recording-starting-position information that represents a position where the nozzle should start to jet the ink, according to recording data, the micro-vibrating-starting-position setting unit for setting micro-vibrating-starting-position information that represents a position where the micro-vibrating unit should start to cause the ink to minutely vibrate, according to the recording-starting-position information, the scanning-position-information outputting unit capable of outputting head-position information that represents a position of the recording head while the recording head is scanning, and/or the pre-recording micro-vibrating controlling unit for judging a micro-vibrating-starting timing according to the micro-vibrating-starting-position information and the head-position information in order to cause the micro-vibrating unit to operate.

Another computer can also materialize: the recording-starting-position setting unit for setting recording-starting-position information that represents a position where the nozzle should start to jet the ink, according to recording data, the micro-vibrating-ceasing-position setting unit for setting micro-vibrating-ceasing-position information that represents a position where the micro-vibrating unit should cease to cause the ink to minutely vibrate, according to the recording-starting-position information, the scanning-position-information outputting unit capable of outputting head-position information that represents a position of the recording head while the recording head is scanning, and/or the pre-recording micro-vibrating controlling unit for judging a micro-vibrating-ceasing timing according to the micro-vibrating-ceasing-position information and the head-position information in order to cause the micro-vibrating unit to stop.

Another computer can also materialize: the recording-starting-position setting unit for setting recording-starting-position information that represents a position where the nozzle or the nozzles of the class should start to jet the ink, according to recording data, the micro-vibrating-starting-position setting unit for determining whether to cause the ink in the nozzle or the nozzles of the class to minutely vibrate according to the recording-starting-position information, and micro-vibrating-starting-position setting unit setting micro-vibrating-starting-position information that represents a position where the micro-vibrating unit should start to cause the ink in the nozzle or the nozzles of the class to minutely vibrate according to the recording-starting-position information if to cause the ink in the nozzle or the nozzles of the class to minutely vibrate is determined, the scanning-position-information outputting unit capable of outputting head-position information that represents a position of the recording head while the recording head is scanning, and/or the pre-recording micro-vibrating controlling unit for judging a micro-vibrating-starting timing for the nozzle or the nozzles of the class according to the micro-vibrating-starting-position information and the head-position information in order to cause the micro-vibrating unit to operate.

A computer can also materialize: the micro-vibrating-ceasing-position setting unit, the thermometry unit, the not-recording micro-vibrating controlling unit, and the mid-recording micro-vibrating controlling unit.

This invention includes a storage unit capable of being read by a computer, storing a program for materializing the above units in a computer system.

This invention also includes the program itself for materializing the above units in the computer system.

BEST MODE FOR CARRYING OUT THE INVENTION

Figure 1:
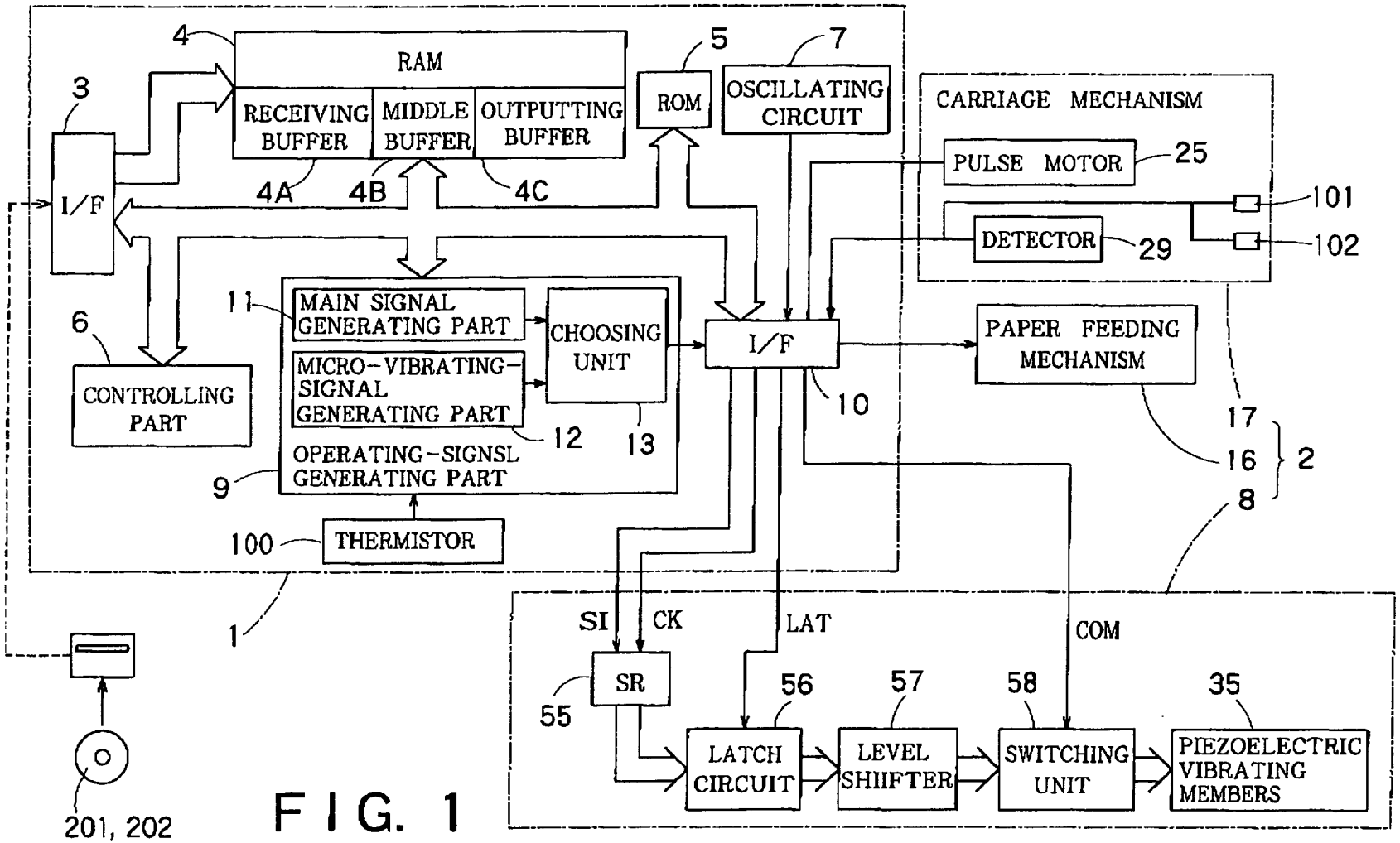
FIG. 1 is a schematic block diagram of an embodiment of the ink-jet recording apparatus according to the invention.

An embodiment of the invention will now be described in more detail with reference to drawings. As shown in FIG. 1, the ink-jet recording apparatus of the embodiment is an ink-jet recording printer having a printer controller 1 and a print engine 2.

The printer controller 1 has: an outside interface (outside I/F) 3, a RAM 4 that is able to temporarily store various data, a ROM 5 that stores a controlling program or the like, a controlling part 6 including a CPU or the like, an oscillating circuit 7 or generating a clock signal, an operating-signal generating part 9 for generating an operating signal that is to be supplied into a recording head 8, and an inside interface (inside I/F) 10 that is adapted to send the operating signal, dot-pattern-data (bit-map-data) developed according to printing data (recording data) or the like to the print engine 2.

The outside I/F 3 is adapted to receive printing data consisting of character codes, graphic functions, image data or the like from a host computer or the like not shown. In addition, a busy signal (BUSY) or an acknowledge signal (ACK) is adapted to be outputted to the host computer or the like through the outside I/P 3.

The RAM 4 has: a receiving buffer 4A, a middle buffer 4B, an outputting buffer 4C and a work memory not shown. The receiving buffer 4A is adapted to receive the printing data through the outside I/F 3, and temporarily store the printing data. The middle buffer 4B is adapted to store middle-code-data converted from the printing data by the controlling part 6. The outputting buffer 4C is adapted to store dot-pattern-data, which are recording-data obtained by decoding (translating) the middle-code-data. The middle-code-data may be gradation data.

ROM 5 stores font data, graphic functions or the like in addition to the controlling program (controlling routine) for carrying out various data-processing operations.

The controlling part 6 is adapted to carry out various controlling operations according to the controlling program stored in the ROM 5. For example, the controlling part 6 reads out the printing data from the receiving buffer 4A, converts the printing data into the middle-code-data, cause the middle buffer 4B to store the middle-code-data. Then, the controlling part 6 analyzes the middle-code-data in the middle buffer 4B and develops (decodes) the middle-code-data into the dot-pattern-data with reference to the font data and the graphic unctions or the like stored in the ROM 5. Then, the controlling part 6 carries out necessary decorating operations to the dot-pattern-data, and thereafter causes the outputting buffer 4C to store the dot-pattern-data.

When the dot-pattern-data corresponding to one line record by one main scanning of the recording head 8 are obtained, the dot-pattern-data are outputted to the recording head 8 from the outputting buffer 4C through the inside I/F 10 in turn. When the dot-pattern-data corresponding to the one line are outputted from the outputting buffer 4C, the middle-code-data that has been developed are deleted from the middle buffer 4B, and the next developing operation starts for the next middle-code-data.

The operating-signal generating part 9 has: a main signal generating part 11 for generating a jetting operating signal that is used for recording (jetting ink), a micro-vibrating-signal generating part 12 for generating a not-recording micro-vibrating signal and a pre-recording micro-vibrating signal that are used for causing meniscus 52 of the ink to minutely vibrate to stir the ink in the nozzle (see FIG. 3B), and a choosing part 13 that is adapted to be inputted the jetting operating signal from the main signal generating part 11 and the not-recording micro-vibrating signal or the pre-recording micro-vibrating signal from the micro-vibrating-signal generating part 12, and to output one of the jetting operating signal, the not-recording micro-vibrating signal and the pre-recording micro-vibrating signal to the inside I/F 10.

The main signal generating part 11 is adapted to function as a jetting-operating-signal generating unit. The micro-vibrating-signal generating part 12 is adapted to function as a micro-vibrating-signal generating unit. The choosing part 13 is adapted to function as a signal-choosing unit.

The operating-signal generating part 9 may consist of logic circuits, or controlling circuits having a CPU, a ROM, a RAM or the like.

The print engine 2 consists of a paper feeding mechanism 16, a carriage mechanism 17 and the recording head 8.

Figure 2A:
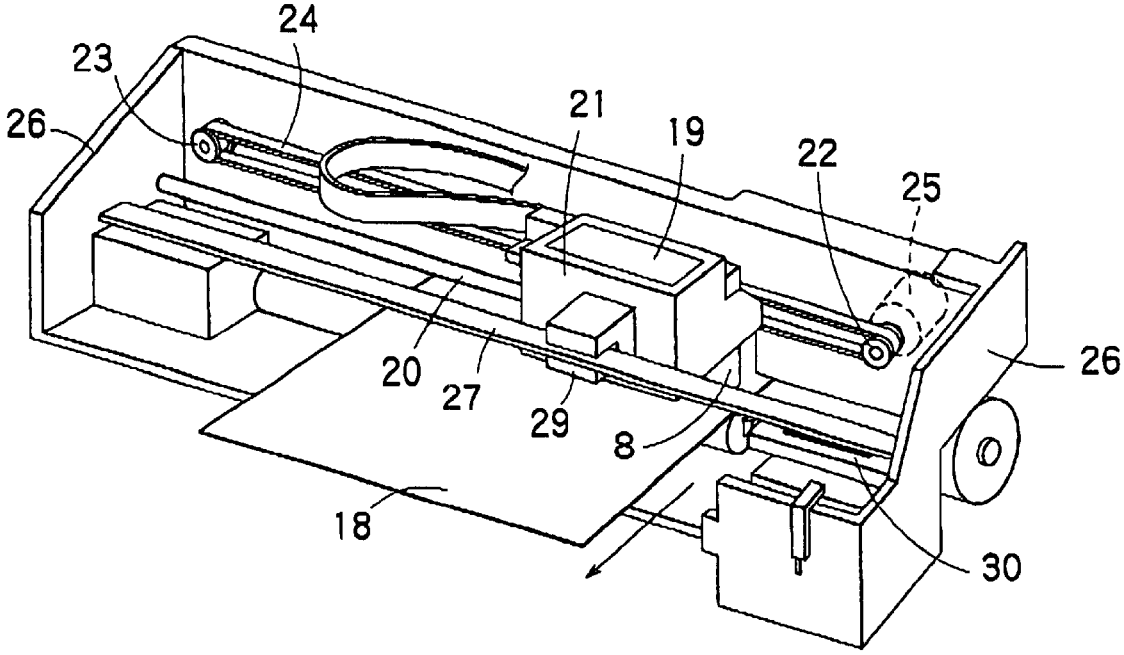
FIG. 2A is a perspective view of the embodiment of the ink-jet recording apparatus shown in FIG. 1.

The paper feeding mechanism 16 consists of a paper feeding motor, a paper feeding roller and so on. As shown in FIG. 2A, a recording paper 18, which is an example of a recording medium, is fed in a subordinate scanning direction in turn by the paper feeding mechanism 16, in cooperation with the scanning operation of the recording head 8.

As shown in FIG. 2A, the carriage mechanism 17 has: a carriage 21 that is slidably mounted on a guiding member 20 and is capable of carrying the recording head 8 and an ink cartridge 19, a timing belt 24 that circulates around a driving pulley 22 and a following pulley 23 and is connected with the carriage 21, a pulse motor 25 for causing the driving pulley 22 to rotate, a linear encoder 27 supported by a printer housing 26 in such a manner that the linear encoder 27 extends in a direction of width of the recording paper 18 (in the main scanning direction), and a slit detector 29 mounted on the carriage 21 and capable of detecting a plurality of slits 28 of the linear encoder 27.

Figure 2B:
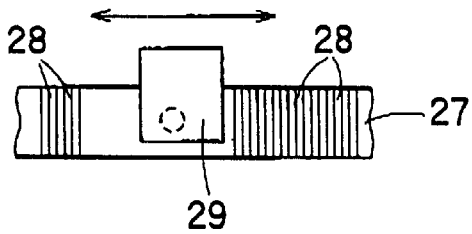
FIG. 2B is a plan view of the linear encoder and the slit detector.
Figure 2C:
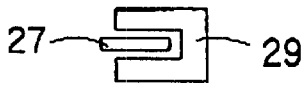
FIG. 2C is a side view of the linear encoder and the slit detector.

As shown in FIGS. 2B and 2C, the linear encoder 27 of the embodiment consists of a transparent plate. The plurality of slits 28 is formed at pitches of 360 dpi in the linear encoder 27. For example, the slit detector 29 may consist of a photo-interrupter.

According to the carriage mechanism 17 described above, the carriage 21 can reciprocate in the width direction of the recording paper 18 (in the main scanning direction) by driving the pulse motor 25. Thus, the recording head 8 mounted on the carriage 21 can also reciprocate in the main scanning direction. For the movement (reciprocation) of the carriage 21, a standard position as a starting point is set at a side of a home position. The home position means a position where the carriage 21 stands by when the electric power is not supplied, when the scanning operation is not carried out for a long time, or the like. In the embodiment, the home position is located in a right end portion of FIG. 2A.

In the embodiment, a capping mechanism 30 is provided at the home position in order to prevent solvent of ink in nozzles 51 (described below) of the recording head 8 from evaporating.

On the other hand, the standard position is located at a little left position with respect to the home position. In detail, the standard position is located between a right end of the recording paper 18 and the capping mechanism 30.

When the carriage 21 is moved, the slit detector 29 is moved together with the carriage 21. During the movement, the slit detector 29 detects the plurality of slits 28 of the linear encoder 27 in turn, and outputs pulse-like detecting signals each of which corresponds to each of slits 28. The controlling part 6 recognizes a position of the recording head 8 based on the detecting signals from the slit detector 29.

In more detail, the controlling part 6 resets a counting value of a position counter when the carriage 21 is positioned at the standard position. Then, the controlling part 6 receives the pulse-like detecting signals from the slit detector 29 in turn while the carriage 21 is moved. The counting value of the position counter increases by one whenever the controlling part 6 receives one pulse-like signal. Thus, the counting value of the position counter functions as head-position information that represents a position of the carriage 21 i.e. a scanning position of the recording head 8. The position counter may be provided in the work memory (not shown) of the RAM 4. Alternatively, the position counter may be provided separately.

Therefore, the linear encoder 27 and the slit detector 29 function as a scanning-position-information outputting unit. That is, they output information about the position of the recording head 8 (detecting signals) during the main scanning of the carriage 21 (recording head 8). The controlling part 6 and the position counter (RAM 4) function as scanning-position-holding means. That is, they hold the counting value that has been updated according to the detecting signals from the slit detector 29.

Figure 3A:
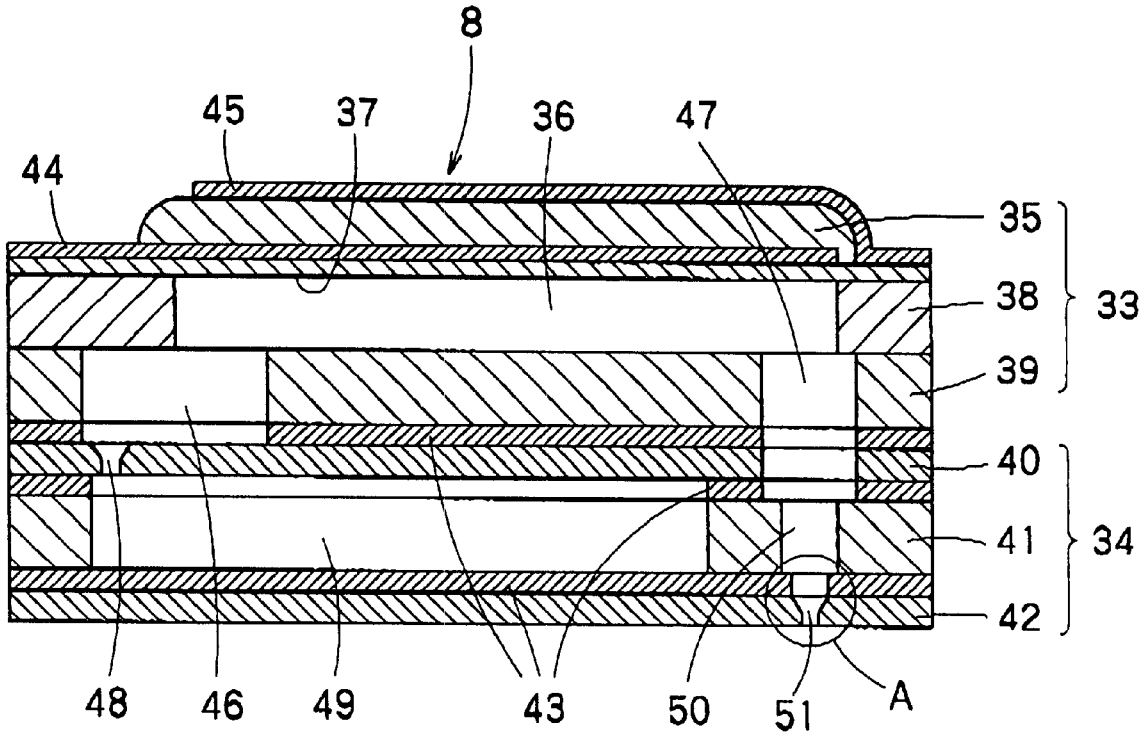
FIG. 3A is a sectional view of the recording head of the ink-jet recording apparatus.

Then, the recording head 8 is explained in more detail. As shown in FIG. 3A, the recording head 8 mainly consists of an actuator unit 33 and an ink-way unit 34. The recording head 8 includes bending-mode piezoelectric vibrating members 35 as pressure generating members.

When electric power is supplied to a ending-mode piezoelectric vibrating member 35, the member 35 contracts to deform a pressure generating chamber 36 in such a manner that a volume of the pressure generating chamber 36 becomes smaller. When electric charges are discharged from the bending-mode piezoelectric vibrating member 35, the member 35 expands to deform the pressure generating chamber 36 in such a manner that the volume of the pressure generating chamber 36 returns to an original state thereof.

The actuator unit 33 comprises a first lid 37, a spacer 38, a second lid 39 and piezoelectric vibrating members 35. The ink-way unit 34 comprises an ink-way forming plate 40, an ink-chamber forming plate 41 and a nozzle plate 42. The actuator unit 33 and the ink-way unit 34 are integrated by an adhesive layer 43 to form the recording head 8. The adhesive layer 43 may consist of a thermal welding film or a suitable adhesive material.

The first lid 37 may be an elastic thin plate made of ceramic in general. In the embodiment, the first lid 37 is made of zirconia ($ZrO_2$) having a thickness of about 6 $\mu$m. A common electrode 44 for the piezoelectric vibrating members 35 is formed on an upper surface of the first lid 37. The electric vibrating members 35 are integrated on the common electrode 44 respectively. Driving electrodes 45 for the piezoelectric vibrating members 35 are provided on upper surfaces of the piezoelectric vibrating members 35, respectively.

The spacer 38 may be a ceramic plate having penetrating holes that form pressure generating chambers 36 respectively. In the embodiment, the spacer 38 is made of zirconia, and has a thickness of about 100 $\mu$m.

The second lid 39 may be a ceramic plate having penetrating holes that form supplying-holes 46 respectively at a left side in FIG. 3A and penetrating holes that form first-nozzle-holes 47 respectively at a right side in FIG. 3A. The second lid 39 may be made of zirconia.

The first lid 37 is arranged on an upper surface of the spacer 38. The second lid 39 is arranged on a lower surface of the spacer 38. That is, the spacer 38 is sandwiched between the first lid 37 and the second lid 39. Each of the first lid 37, the spacer 38 and the second lid 39 is molded into a predetermined shape out of clay-like ceramic. Then, the first lid 37, the spacer 38 and the second lid 39 are layered and integrated by baking.

The ink-way forming plate 40 may be a plate having penetrating holes that form ink-supplying-openings 48 respectively at a left side in FIG. 3A and penetrating holes that form first-nozzle-holes 47 respectively at a right side in FIG. 3A. The ink-chamber forming plate 41 may be a plate having penetrating holes that form an ink chamber 49 at a left and middle side in FIG. 3A and penetrating holes that form second-nozzle-holes 50 respectively at a right side in FIG. 3A. The nozzle plate 42 may be a thin plate having nozzles 51 at a right side in FIG. 3A. The nozzles 51 are arranged at pitches (at intervals) that correspond to a density of forming dots, in a subordinate scanning direction. The number of the nozzles is for example 48. The nozzle plate 42 may be made of stainless steel.

The nozzle plate 42 is arranged on a lower surface of the ink-chamber forming plate 41 via an adhesive layer 43. The ink-way forming plate 40 is arranged on an upper surface of the ink-chamber forming plate 41 via an adhesive layer 43. Thus, the ink-way forming plate 40, the ink-chamber forming plate 41 and the nozzle plate 42 are integrated as the ink-way unit 34.

In the recording head 8 described above, the ink chambers 49 of the in-way unit 34 are communicated with the supplying-holes 46 of the actuator unit 33 through the ink-supplying-openings 48 respectively. The supplying-holes 46 are communicated with the first-nozzle-holes 47 through the pressure generating chambers 46 respectively. The nozzles 51 are communicated with the first-nozzle-holes 47 through the second-nozzle-holes 50 respectively. Thus, ink-ways are formed from the ink chamber 49 to the nozzles 51 through the pressure chambers 36 respectively. Ink in the ink cartridge 19 is adapted to be supplied into the ink chamber 49 through an ink supplying way not shown.

The ink can be jetted from the nozzles 51 by changing the volumes of the pressure chambers 36. In more detail, when electric poser is supplied to a piezoelectric vibrating member 35, the piezoelectric vibrating member 35 contracts in a direction perpendicular to a direction of the electric field. Then, the first lid 37 is deformed in such a manner that a pressure chamber 36 corresponding to the piezoelectric vibrating member 35 contracts with respect to an original state thereof. On the other hand, when electric charges are discharged from the piezoelectric vibrating member 35, the piezoelectric vibrating member 35 expands in the direction perpendicular to the direction of the electric field. Then, the first lid 37 is deformed in such a manner that the pressure chamber 16 corresponding to the piezoelectric vibrating member 35 expands back to the original state thereof. When the pressure chamber 35 contracts rapidly after the pressure chamber 36 has expanded, a pressure of ink in the pressure chamber 36 increases rapidly. Thus, an ink drop is jetted from the nozzle 51 corresponding to the pressure chamber 36 as shown by an alternate long and short dash line in FIG. 3B.

Figure 3B:
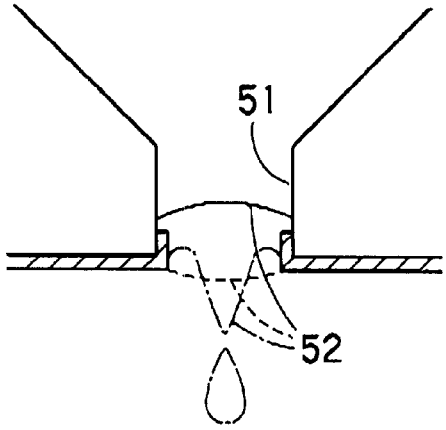
FIG. 3B is an enlarged view of the A portion of the FIG. 3A.
Figure 4:
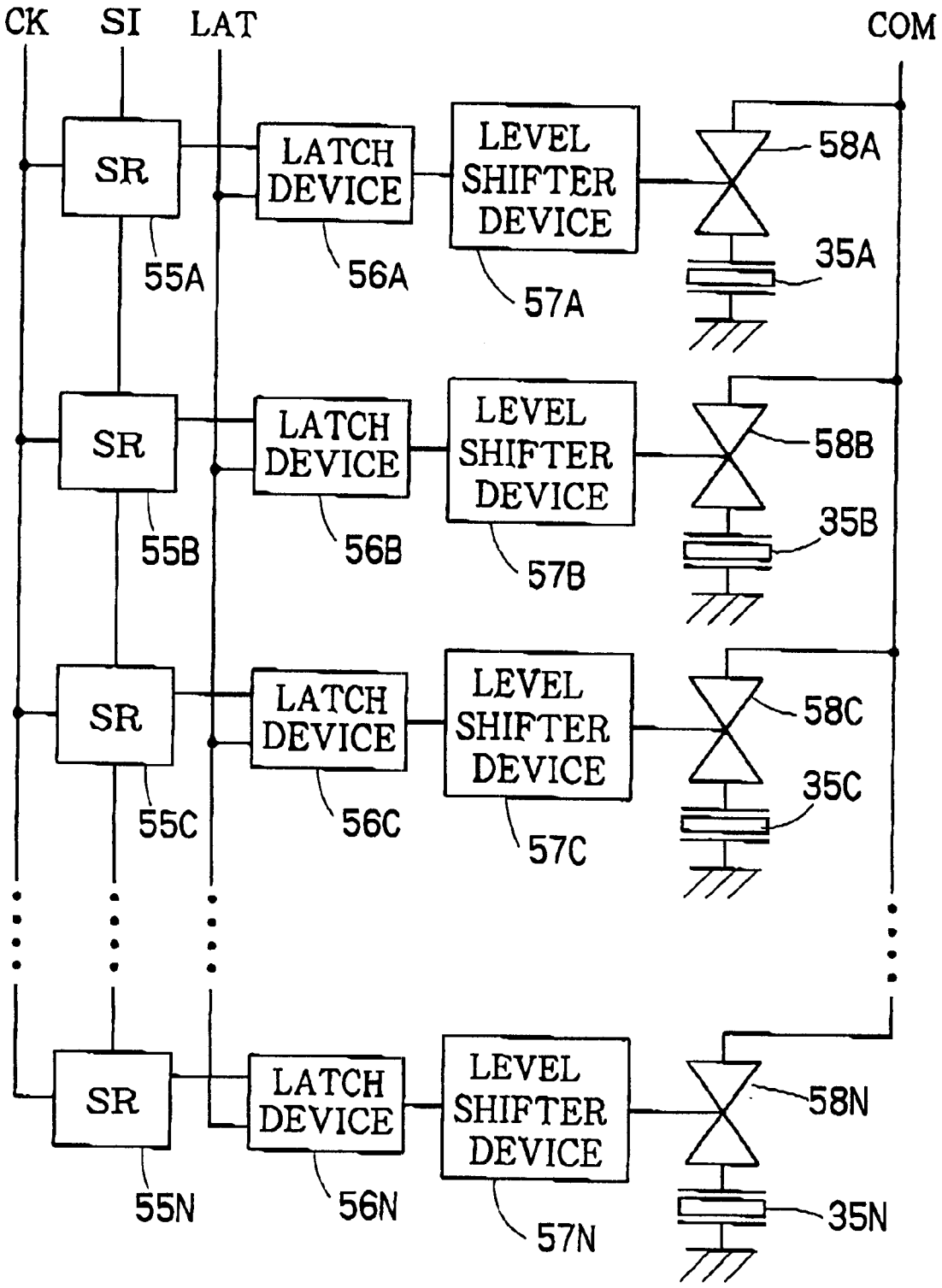
FIG. 4 is a schematic block diagram for explaining an electric structure of the recording head.

On the other hand, by causing the pressure chamber 36 to expand and contract in such a manner that the ink in the nozzle 51 is not jetted, the ink in the nozzle 51 can be stirred in order to prevent the viscosity of the ink from increasing. In more detail, a meniscus 52 (free surface of the ink exposed at an opening of the nozzle 51) can be caused to minutely vibrate i.e. move to a jetting direction of the ink and to a contracting direction opposed to the jetting direction by turns as shown in FIG. 3B, by causing the pressure chamber 36 to expand and contract in such a manner that the ink is not jetted. Owing to the vibration of the meniscus, the ink at the opening of the nozzle can be stirred in order to prevent the viscosity of the ink from increasing.

Then, an electric structure of the recording head 8 is explained. As shown in FIG. 1, the recording head 8 includes a shift register 55, a latch circuit 56, a level shifter 57 and a switching unit 58 and the piezoelectric vibrating members 35, which are electrically connected in the order. The shift register 55 has a plurality of shift register devices 55A to 55N each of which corresponds to each of the nozzles 51. Similarly, the latch circuit 56 has a plurality of latch devices 56A to 56N each of which corresponds to each of the nozzles 51, the level shifter 57 has a plurality of level shifter devices 57A to 57N each of which corresponds to each of the nozzles 51, and the switching unit 58 has a plurality of switching devices 55A to 55N each of which corresponds to each of the nozzles 51. In addition, each of the piezoelectric vibrating members 35 corresponds to each of the nozzles 51. Thus, the piezoelectric vibrating members 35 are also designated as piezoelectric vibrating members 35A to 35N.

The shift register 55, the latch circuit 56, the level shifter 57, the switching unit 58 and the controlling part 6 are adapted to function as operating-pulse supplying means. That is, they can generate as operating pulse from a jetting operating signal from the operating-signal generating part 9, and output the operating pulse to the piezoelectric vibrating members 35 of the recording head 8.

In addition, the shift register 55, the latch circuit 56, the level shifter 57, the switching unit 58 and the controlling part 6 are also adapted to function as micro-vibrating-signal supplying means. That is, they can supply a not-recording micro-vibrating signal or a pre-recording micro-vibrating signal from the micro-vibrating-signal generating part 12 to the recording head 8 (piezoelectric vibrating members 35). Alternatively, they can generate a mid-recording micro-vibrating signal from a jetting operating signal, and output the signal to the recording head 8.

Then, a controlling operation for jetting ink is explained. At first, an operating pulse is supplied to the piezoelectric vibrating members 35 as follows. Herein, each unit of printing data corresponds to one dot of dot-pattern-data and consists of a plurality of bits.

In the case, the controlling part 6 transfers in a serial manner and sets in turn data of respective uppermost bits of the units of the printing data (SI) from the outputting buffer 4C to the shift register devices 55A to 55N respectively, synchronously with the clock signal (CK) from the oscillating circuit 7. When the uppermost data of all the units for all the nozzles 51 are set in the shift register devices 55A to 55N, the controlling part 6 outputs latch signals (LAT) to the latch circuit 56 i.e. the latch devices 56A to 56N at a suitable timing. Owing to the latch signals, the latch devices 56A to 56N latch the data set in the shift register devices 55A to 55N respectively. The latched data are supplied to the level shifter 57 i.e. the level shift devices 57A to 57N respectively. The level shifter 57 is adapted to function as a voltage amplifier.

For example, when the set datum is 1, each of the level shifter devices 57A to 57N raises the datum to a voltage of several decade volt that can drive the switching unit 58. The raised datum is applied to the switching unit 58 i.e. each of the switching devices 58A to 58N. Each of the switching devices 58A to 58N is closed (connected) by the raised datum. On the other hand, when the set datum is 0, each of the level shifter devices 57A to 57N does not raise the datum.

A jetting operating signal (COM) from the main-signal generating part 11 is applied to each of the switching devices 58A to 58N. When each of the switching devices 58A to 58N is closed, the jetting operating signal is supplied to each of the piezoelectric vibrating members 35A to 35N that are connected to the switching devices 58A to 58N.

After the jetting operating signal has been supplied to the piezoelectric vibrating members based on the uppermost bits, the controlling part 6 transfers in a serial manner and sets data or respective secondly uppermost bits of the units of the printing data (SI) to the shift register devices 55A to 55N respectively. When the second data are set in the shift register devices 55A to 55N, the controlling part 6 outputs latch signals (LAT) to the latch circuit 56 to latch the set data, and the jetting operating signal is supplied to each of the piezoelectric vibrating members 35A to 35N respectively. Thereafter, the similar operations are repeated for from the thirdly uppermost bits to the lowermost bits in the order.

As described above, the printer can control whether to supply the jetting operating signal to the piezoelectric vibrating members 35 base on the printing data. That is, if the printing datum is 1, the jetting operating signal may be supplied to the corresponding piezoelectric vibrating member 35, while if the printing datum is 0, the jetting operating signal may not be supplied to the corresponding piezoelectric vibrating member 35. Herein, if the printing datum is 0, the piezoelectric vibrating member 35 holds previous electric charges i.e. a previous voltage.

Thus, a plurality of operating pulses and mid-recording micro-vibrating signal can be made selectively from one jetting operating signal, when the jetting operating signal is divided into some sections with respect to time and each of the bits of the units of the printing data is set correspondingly to each of the divided sections of the jetting operating signal. One of the generated operating pulses and mid-recording micro-vibrating signal may be supplied to each of the piezoelectric vibrating members 35. Thus, a meniscus 52 of ink in a nozzle not in a recording operation can minutely vibrate while another nozzle is in the recording operation. In addition, the plurality of operating pulses corresponding to a plurality of volumes of ink (dot diameters) can be supplied to each of the piezoelectric vibrating members 35 of the recording head 8.

Figure 5:
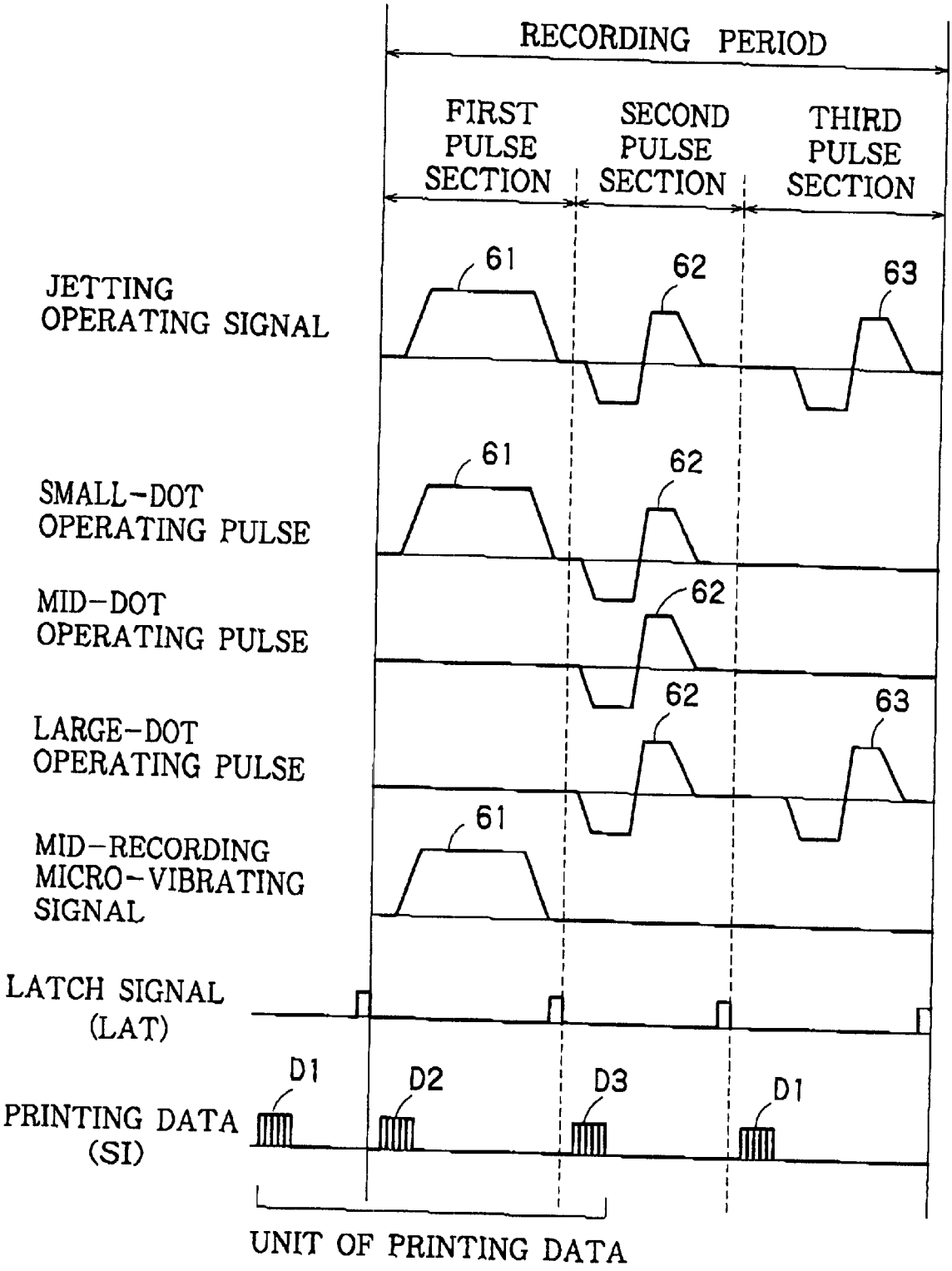
FIG. 5 is an explanatory view of a jetting operating signal and operating pulses generated from the jetting operating signal.

For example, as shown in FIG. 5, the jetting operating signal is divided into a first pulse section 61, a second pulse section 62 and a third pulse section 63. A small-dot operating pulse is generated by combining the first pulse section 61 and the second pulse section 62. A mid-dot operating pulse is generated by the second pulse section 62 solo. A large-dot operating pulse is generated by combining the second pulse section 62 and the third pulse section 63. A mid-recording micro-vibrating signal is generated by the first pulse section 61 solo.

The small-dot operating pulse is an operating pulse that can cause a small ink drop forming a small-sized dot to be jetted. The mid-dot operating pulse is an operating pulse that can cause a mid-sized ink drop forming a middle-sized dot to be jetted. The large-dot operating pulse is an operating pulse that can cause a large ink drop forming a large-sized dot to be jetted. The mid-recording micro-vibrating pulse (signal) is an operating pulse that can cause the meniscus of the ink in the nozzle 51 not in the recording operation to minutely vibrate.

When the mid-recording micro-vibrating signal is supplied to the piezoelectric vibrating member 35, the meniscus 52 can minutely vibrate between a position of a jetting side and a position of a contracting side nearer to the pressure chamber 36. In FIG. 3B, the position of the jetting side is designated by a broken line, and the position of the contracting side is designated by a real line. Owing to the vibration of the meniscus 52, the ink at the opening of the nozzle can be stirred.

In the embodiment, the unit of the printing data consist of data of 3 bits D1, D2 and D3. when D1=1, D2=1 and D3=0 are set, the small-dot operating pulse is adapted to be generated. When D1=0, D2=1 and D3=0 are set, the mid-dot operating pulse is adapted to be generated. When D1=0, D2=1 and D3=1 are set, the large-dot operating pulse is adapted to be generated. When D1=1 D2=0 and D3=0 are set, the mid-recording micro-vibrating signal is adapted to be generated.

On the other hand, in the case of causing the meniscus 52 to minutely vibrate by the not-recording micro-vibrating signal of the pre-recording micro-vibrating signal from the micro-vibrating-signal generating part 12 to stir the ink, 1 is set for each of the printing data for all the nozzles 51 during the stirring. Thus, a series of micro-vibrating signals generated by the micro-vibrating-signal generating part 12 may be supplied to the piezoelectric vibrating members 35 as it is. Then, the piezoelectric vibrating members 35 are deformed to cause the menisci 52 to minutely vibrate.

Figure 6:
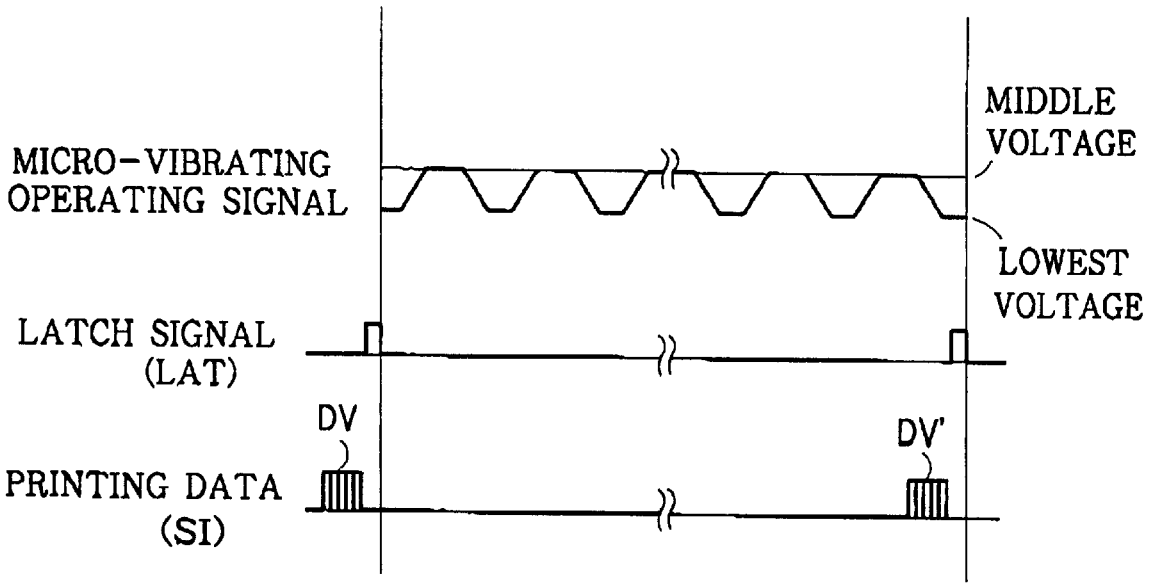
FIG. 6 is an explanatory view of a micro-vibrating operating signal.

The not-recording micro-vibrating signal and the pre-recording micro-vibrating signal are usually identical with each other. As shown in FIG. 6, the identical signal may include a series of trapezoidal pulses in such a manner that an upper level of each of the pulses is a middle voltage and that a lower level of each of the pulses is a lowest voltage. When one of the two micro-vibrating signals is supplied to the piezoelectric vibrating members 35, the pressure chambers 36 repeat to minutely expand and contract. Thus, similarly to the case by the mid-recording micro-vibrating signal as shown in FIG. 3B, each of the menisci 52 can minutely vibrate between a position of a jetting side and a position of a contracting side.

In the case of supplying one of the two micro-vibrating signals to the piezoelectric vibrating members 35, printing data DV for such a micro-vibrating operation, wherein each of data for all the nozzles 51 is 1, are set in the shift register 55. Then, the controlling part 6 outputs latch signals to the latch circuit 56 to latch the set printing data DV to close the switching unit 58. In the case of stopping to supply the micro-vibrating signal to the piezoelectric vibrating members 35, printing data DV' for a micro-vibrating stopping operation, wherein each of data for all the nozzles 51 is 0, are set in the shift register 55. Then, the controlling part 6 outputs latch signals to the latch circuit 56 to latch the set printing data DV' to shut down the switching unit 58.

Then, a scanning operation including a recording operation of the printer described above is explained in more detail. In the printer, the menisci 52 can minutely vibrate to prevent the viscosity of ink from increasing in cooperation with a main scanning of the recording head 8, i.e., in cooperation with the scanning operation for a line. In more detail, the menisci 52 can minutely vibrate while the recording head 8 (carriage 21) is being accelerated, just before the starting of the recording operation, and during the recording operation.

Figure 7:
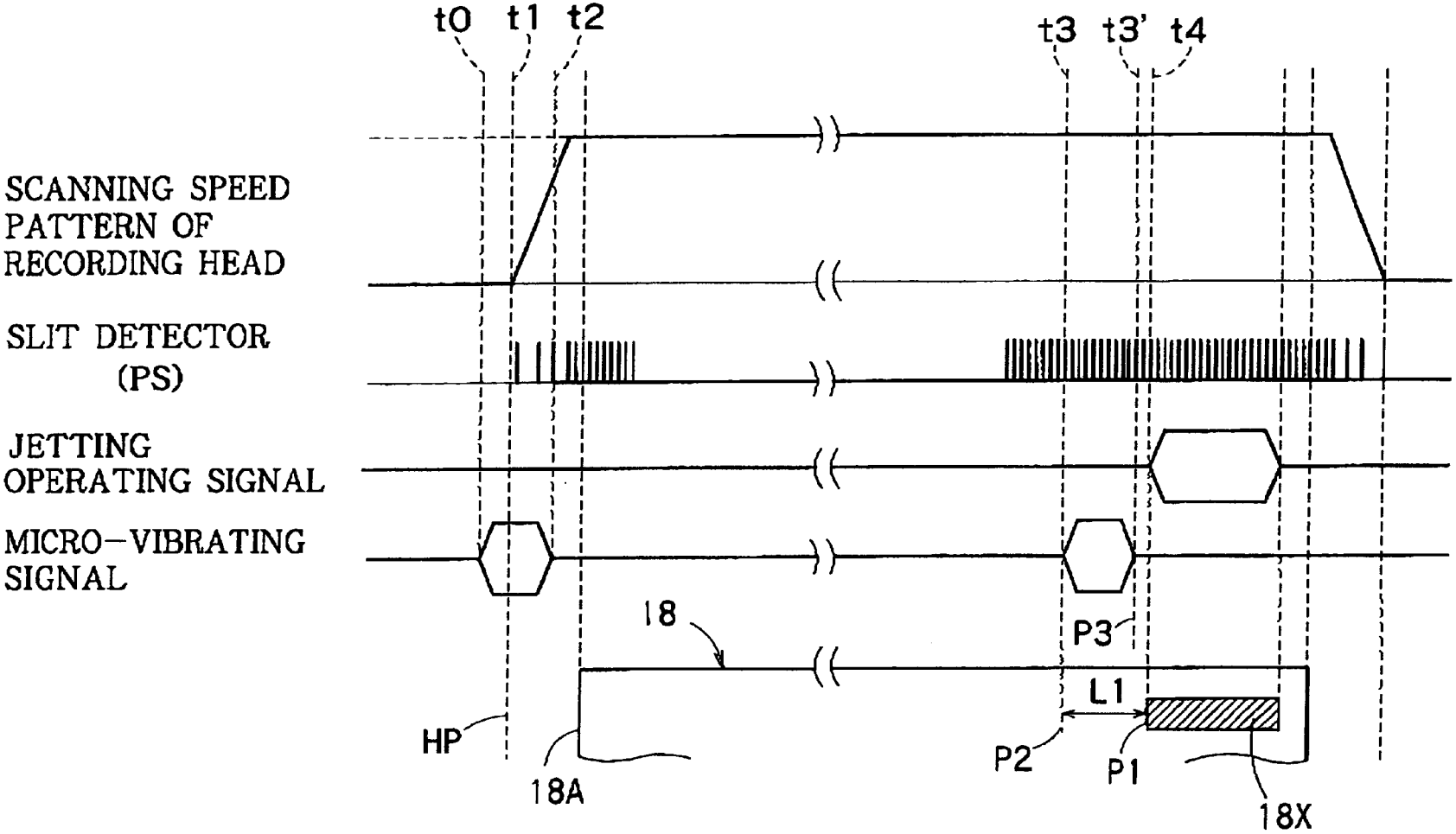
FIG. 7 is a timing chart for explaining a scanning operation including a recording operation for a line.

As shown in FIG. 7, in the case, an image 18x is recorded in an area opposed to the home position HP in the recording paper 18, that is, in the latter half of a line.

Figure 8:
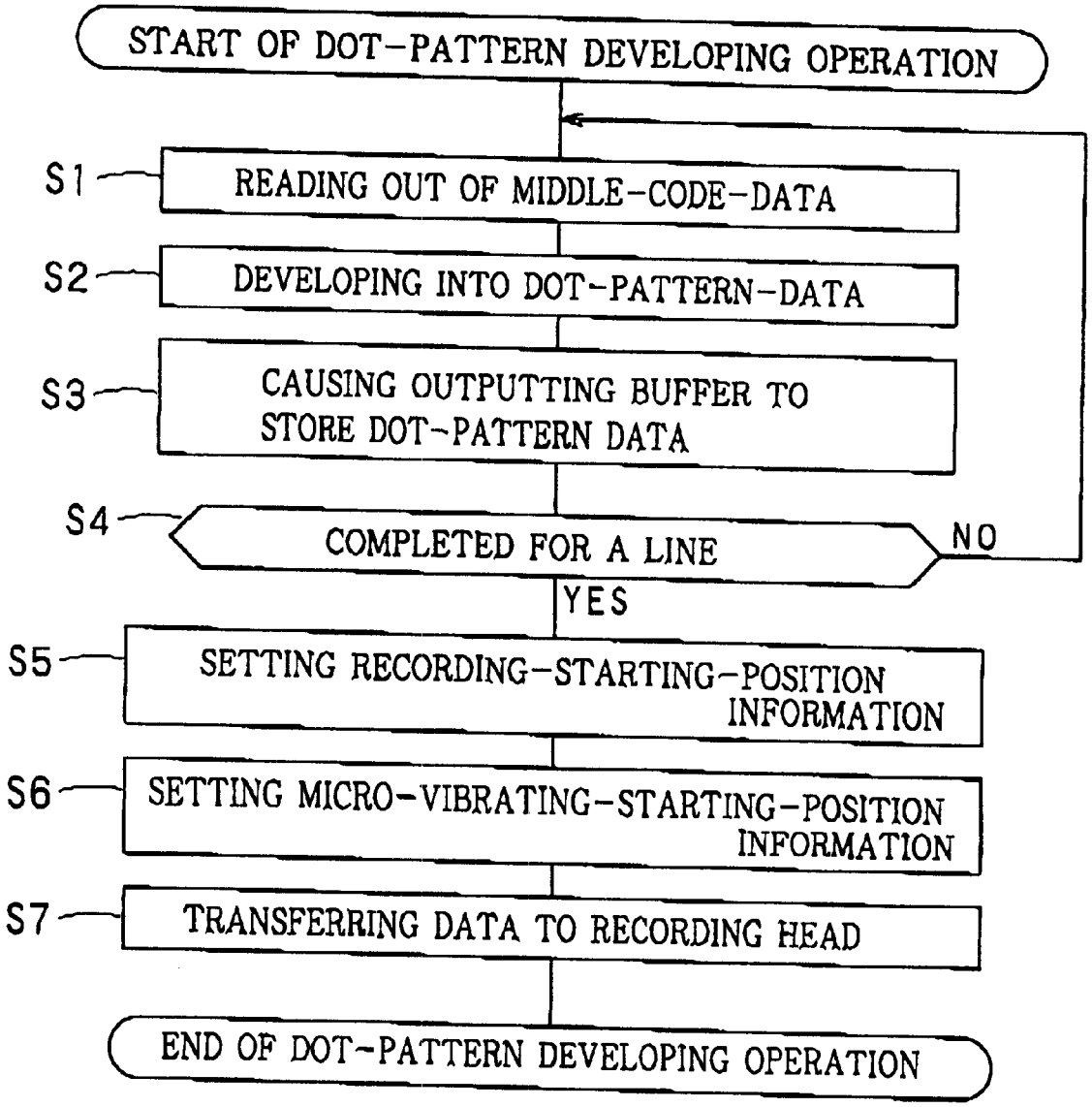
FIG. 8 is a flowchart for explaining a scanning operation including a dot-pattern developing operation.
Figure 9A:
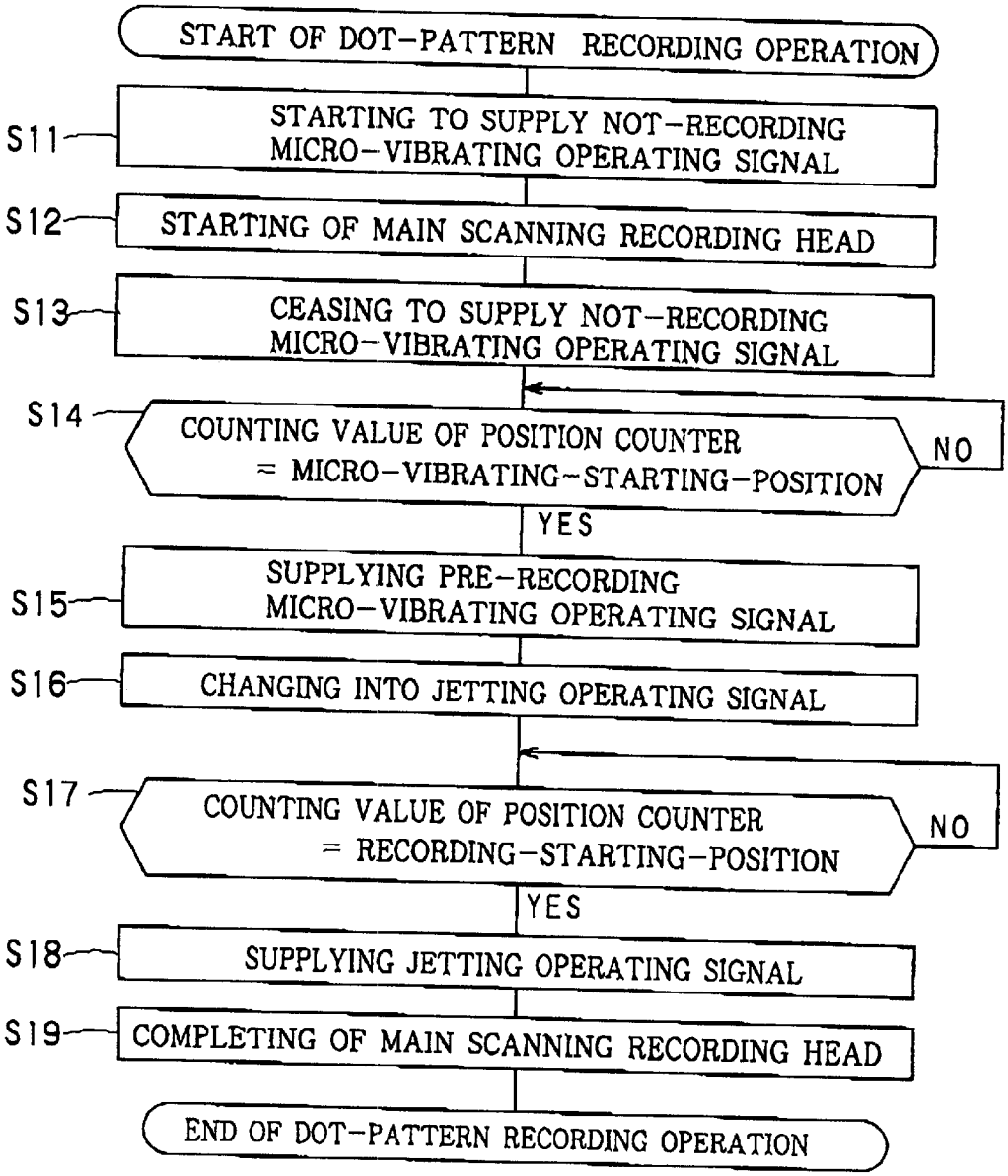
FIG. 9A is a flowchart for explaining a dot-pattern recording operation.
Figure 9B:
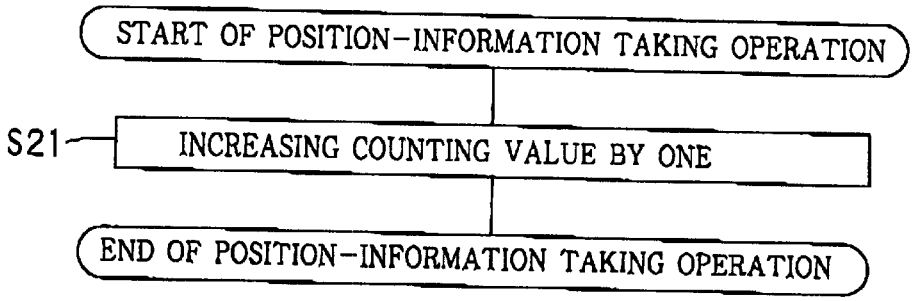
FIG. 9B is a flowchart for explaining a position-information taking operation.

FIG. 7 is a timing chart for explaining the scanning operation including the recording operation for the line. In FIG. 7, there are also shown the recording paper 18, and a relationship between a recording area by the recording head 8 and time. FIG. 8 if a flowchart for explaining a dot-pattern developing operation. FIG. 9A is a flowchart for explaining a dot-pattern recording operation. FIG. 9B is a flowchart for explaining a position-information taking operation that may be carried out interrupting the dot-pattern recording operation.

The recording operation is mainly divided into the dot-pattern developing operation for generating dot-pattern-data for the line from the middle-code-data, and the dot-pattern recording operation for recording (jetting ink) on the recording paper 18 based on the developed dot-pattern-data.

Each of the dot-pattern developing operation and the dot-pattern recording operation is explained as below.

In the dot-pattern developing operation shown in FIG. 8, the controlling part 6 functions as a dot-pattern-data generating unit to generate the dot-pattern-data for the line. That is, the controlling part 6 reads out middle-code-data stored in the middle buffer 4B (S1), develops the middle-code-data into a part of the dot-pattern-data based on the font data and the graphic functions or the like stored in the ROM 5 (S2), and causes the outputting buffer 4C to store the part of the developed dot-pattern-data (S3). Then, the developing operation is repeated until all the parts of the dot-pattern-data for the line are stored in the outputting buffer 4C (S4).

When the dot-pattern-data corresponding to the line are stored in the outputting buffer 4C, the controlling part 6 functions as a recording-starting-position-information setting unit to set recording-starting-position information that represents a position where a nozzle should start to record in the line, that is, where a first ink drop should be jetted from the nozzle during the main scanning (S5). In FIG. 7, the recording-starting-position is designated by a reference sign P1.

In the embodiment, the recording-starting-position information is set correspondingly to the counting value about the slits 28 of the linear encoder 27, that is, the counting value of pulses PS outputted from the slit detector 29.

Then the controlling part 6 functions as a micro-vibrating-starting-position-information setting unit to set micro-vibrating-starting-position information that represents a position where the micro-vibrating unit should start to cause the ink to minutely vibrate, for example just before starting the recording operation (S6). For example, the micro-vibrating-starting-position is set at a position P2 back to the home position HP from the recording-starting-position P1 by a distance L1 that is necessary for the menisci to keep minutely vibrating and to settle down thereafter. That is, the setting of the micro-vibrating-starting-position P2 is carried out based on the recording-starting-position information that has been set previously. Then, a counting value obtained by subtracting a counting value corresponding to the distance L1 from a counting value corresponding to the recording-starting-position P1 is set as a counting value corresponding to the micro-vibrating-starting-position P2.

When the micro-vibrating-starting-position information is set, the controlling part 6 transfers the developed dot-pattern-data to the recording head 8 (S7). On transferring the developed dot-pattern-data, a scanning operation starts for the line, that is, the recording head 8 starts scanning in the main scanning direction. In addition, a micro-vibrating controlling operation that cause the menisci 52 to minutely vibrate to stir the ink in the nozzles 51 is carried out in cooperation with the main scanning of the recording head 8. During the micro-vibrating controlling operation, the controlling part 6 functions as a micro-vibrating controlling unit.

After transferring the dot-pattern-data, the controlling part 6 carries out the dot-pattern recording operation. In the dot-pattern recording operation, the controlling part 6 functions as a not-recording micro-vibrating controlling unit (one kind of the micro-vibrating controlling unit) to stir the ink while the carriage 21 is being accelerated. That is, on transferring the dot-pattern-data, the controlling part 6 supplies a not-recording micro-vibrating signal from the micro-vibrating-signal generating part 12 to the piezoelectric vibrating members 24 of the recording head 8.

As shown in FIGS. 7 and 9A, the controlling part 6 starts to supply the not-recording micro-vibrating signal (S11, t0, and then starts the scanning of the recording head (S12, t1). In the case, the controlling part 6 ceases to supply the not-recording micro-vibrating signal at a timing just before a speed of the recording head 8 ceases to increase but becomes constant (S13, t2).

During the series of steps, at first, the controlling part 6 outputs such a controlling signal to the choosing part 13 that the not-recording micro-vibrating signal from the micro-vibrating-signal generating part 12 is allowed to be supplied to the piezoelectric vibrating members 35. Then, the controlling part 6 sets the printing data DV for the micro-vibrating operation in the shift register 55, and outputs the latch signals to the latch circuit 56 in order to supply the not-recording micro-vibrating signal to the piezoelectric vibrating members 35 (see FIG. 6). Then, the controlling part 6 supplies an operating pulse to the pulse motor 25 to move the carriage 21 in the main scanning direction. Thus, the recording head 8 starts scanning. Then, the controlling part 6 sets the printing data DV' for the micro-vibrating stopping operation in the shift register 55, and outputs the latch signals at a stopping timing of the not-recording micro-vibrating signal in order to cease to supply the micro-vibrating signal to the piezoelectric vibrating members 35.

During the scanning of the recording head 8, the slit detector 29 mounted on the carriage 21 detects the slits 28 of the linear encoder 27, and outputs pulse-like detecting signals that are shown with reference sign PS in FIG. 7. The controlling part 6 watches the detecting signals and carries out the position-information taking operation whenever each of the detecting signals is received. The position-information taking operation is carried out interrupting the dot-pattern recording operation. In the position-information operation, the position counter is updated (S21). In more detail, the counting value of the position counter that represents head-position information increases by one based on each of the detecting signals from the slit detector 29. After the counting value has increased by one, the dot-pattern recording operation is resumed. Herein, the counting value of the position counter may be reset when the scanning of the recording head 8 for the line is completed or when the recording head 8 is returned at the standard position.

During the scanning of the recording head 8, the controlling part 6 also functions as a pre-recording micro-vibrating-starting-timing judging unit, that is, judges a micro-vibrating-starting timing just before the recording operation (S14). In the embodiment, the controlling part 6 can judge the pre-recording micro-vibrating-starting timing by comparing the counting value of the position counter with the counting value corresponding to the micro-vibrating-starting-position P2 (micro-vibrating-starting-position information) because the controlling part 6 watches the counting value of the position counter (t3).

When the controlling part 6 judges that it is the pre-recording micro-vibrating-starting timing, the controlling part 6 functions as a pre-recording micro-vibrating controlling unit (one kind of the micro-vibrating controlling unit) to supply a pre-recording micro-vibrating signal to the piezoelectric vibrating members 35 (S15). That is, the controlling part 6 sets the printing data DV for the micro-vibrating operation in the shift register 55, and outputs the latch signals to the latch circuit 56 in order to start to supply the pre-recording micro-vibrating signal from the micro-vibrating-signal generating part 12 to the piezoelectric vibrating members 35 (see FIG. 6). On the other hand, the controlling part 6 sets the printing data DV' for the micro-vibrating stopping operation in the shift register 55, and outputs the latch signals at a predetermined stopping timing (t3') of the pre-recording micro-vibrating signal in order to cease to supply the pre-recording micro-vibrating signal to the piezoelectric vibrating members 35 (see FIG. 6).

The predetermined stopping timing (t3') can be judged by using a timer for measuring a time (t3'–t3) for which the pre-recording micro-vibrating signal is being supplied. In the case, the predetermined stopping timing (t3') can be judged when the pre-recording micro-vibrating signal is supplied for the predetermined time (t3'–t3). Alternatively, the predetermined stopping timing (t3') can be judged by comparing the counting value of the position counter with a predetermined counting value P3.

While the pre-recording micro-vibrating signal is supplied, the menisci 52 minutely vibrates to stir the ink. Thus, the viscosity of the ink in the nozzles may be returned at a normal level even when the viscosity of the ink at the openings in the nozzles has increased as the solvent of the ink has evaporated.

Then, after ceasing to supply the pre-recording micro-vibrating signal, the controlling part 6 outputs such a controlling signal to the choosing part 13 of the operating-signal generating part 9 that the jetting operating signal from the main signal generating part 11 is allowed to be supplied to the piezoelectric vibrating members 35 (S16).

After outputting the above controlling signal, the controlling part 6 also functions as a recording-starting-timing judging unit, that is, judges a recording-starting timing (S17). In the embodiment, the controlling part 6 can judge the recording-starting timing by comparing the counting value of the position counter with the counting value corresponding to the recording-starting-position P1 because the controlling part 6 watches the counting value of the position counter (t4).

When the controlling part 6 judges that it is the recording-starting timing, the controlling part 6 supplies the jetting operating signal to the piezoelectric vibrating members 35 to record (jet the ink) on the recording paper 18 (S18). In the case, as shown in FIG. 5, one of the small-dot operating pulse, the mid-dot operating pulse, the large-dot operating pulse and the mid-recording micro-vibrating signal is supplied to each of the piezoelectric vibrating members 35A to 35N, based on the dot-pattern-data.

Then, a small-sized dot, a middle-sized dot or a large-sized dot is formed on the recording paper by the ink drop jetted from the nozzle, correspondingly to the supplied operating pulse.

In addition, the mid-recording micro-vibrating signal is supplied for a nozzle or nozzles 51 which do not jet ink, so that a meniscus or menisci 52 of the ink in the nozzle or the nozzles 51 can minutely vibrate to stir the ink. Herein, the controlling part 6 functions as a mid-recording micro-vibrating-signal controlling unit (one kind of the micro-vibrating controlling unit).

According to the above control, the ink drop can be jetted in a state wherein the viscosity of the ink is returned at a normal level by the micro-vibrating of the meniscus 52 just before the jetting. Thus, a first ink drop of a line can be jetted accurately in a predetermined direction. Therefore, the deterioration of the quality of the recorded (printed) image is effectively prevented especially at the position where the printing operation starts even when the volume of the jetted ink is so small that the viscosity of the ink is liable to increase.

When the recording paper is large-sized, the ink drop may not be jetted for such a longer time that the viscosity of the ink is liable to increase. However, even in the case, the above control can certainly prevent the deterioration of the quality of the printed image at the position where the printing operation starts.

After the scanning operation for the line is completed, the pulse motor 25 is stopped (S19). Then, the recording head 8 is moved toward the home position HP, and is positioned at the standard position. Then, the similar scanning operation including the recording operation is repeated for the next line.

In the above embodiment, the menisci 52 can minutely vibrate to stir the ink both of while the carriage 21 is being accelerated and for a predetermined time just before the recording operation. However, the pre-recording micro-vibrating just before the recording operation may be carried out only when the recording operation starts at a position in a predetermined area, for example in the latter half of a line. That is, the controlling part 6 (micro-vibrating controlling unit) may carry out the pre-recording micro-vibrating operation only when a recording-starting position represented by the recording-starting-position information is in the right (latter) area with respect to a predetermined position. In the case as well, the viscosity of the ink is sufficiently prevented from increasing, because the ink may be sufficiently stirred by only the not-recording micro-vibrating operation (micro-vibrating operation during the accelerating time) when the recording operation starts at a position in the left (former) area with respect to the predetermined position.

In addition, in general, the printer is arranged in an environment whose temperature is in a wide range of from several centigrade to about forty centigrade. There is a difference in the viscosity of the ink between at a higher temperature and at a lower temperature. That is, the viscosity of the ink at the lower temperature is relatively high, while the viscosity of the ink at the higher temperature is relatively low. Because of the difference in the viscosity of the ink by the temperature, if the same micro-vibrating signal is applied for the case of the higher temperature and for the case of the lower temperature, the menisci 52 may vibrate with a greater amplitude than a necessary amplitude in the case of the higher temperature, while the menisci 52 may not sufficiently vibrate in the case of the lower temperature.

Therefore, as shown in FIG. 1, it is preferable that a thermistor (one kind of thermometry unit) 100 for measuring the environmental temperature is provided, and that an operating voltage of the micro-vibrating signal (not-recording micro-vibrating signal, pre-recording micro-vibrating signal or mid-recording micro-vibrating signal) can be changed based on the temperature measured by the thermistor 100. For example, the thermistor 100 is mounted on a print substrate (not shown) of the recording head 8 to measure a temperature of a surrounding of the recording head 8 accurately.

The operating-signal generating part 9 sets the voltage of the micro-vibrating signal in such a manner that the menisci 52 can minutely vibrate with a relatively stronger force, when the environmental temperature is lower, that is, the viscosity of the ink is higher. On the other hand, the operating-signal generating part 9 sets the voltage of the micro-vibrating signal in such a manner that the menisci 52 can minutely vibrate with a relatively weaker force, when the environmental temperature is higher, that is, the viscosity of the ink is lower. Thus, the menisci 52 can vibrate with a substantially constant amplitude to stir the ink at the openings of the nozzles most suitably, regardless of the environmental temperature.

In the above embodiment, the printer includes the recording head 8 having the bending-mode piezoelectric vibrating members 35. However, the printer may include a recording head 70 having a longitudinal-mode piezoelectric vibrating unit 73, instead of the recording head 8.

Figure 10:
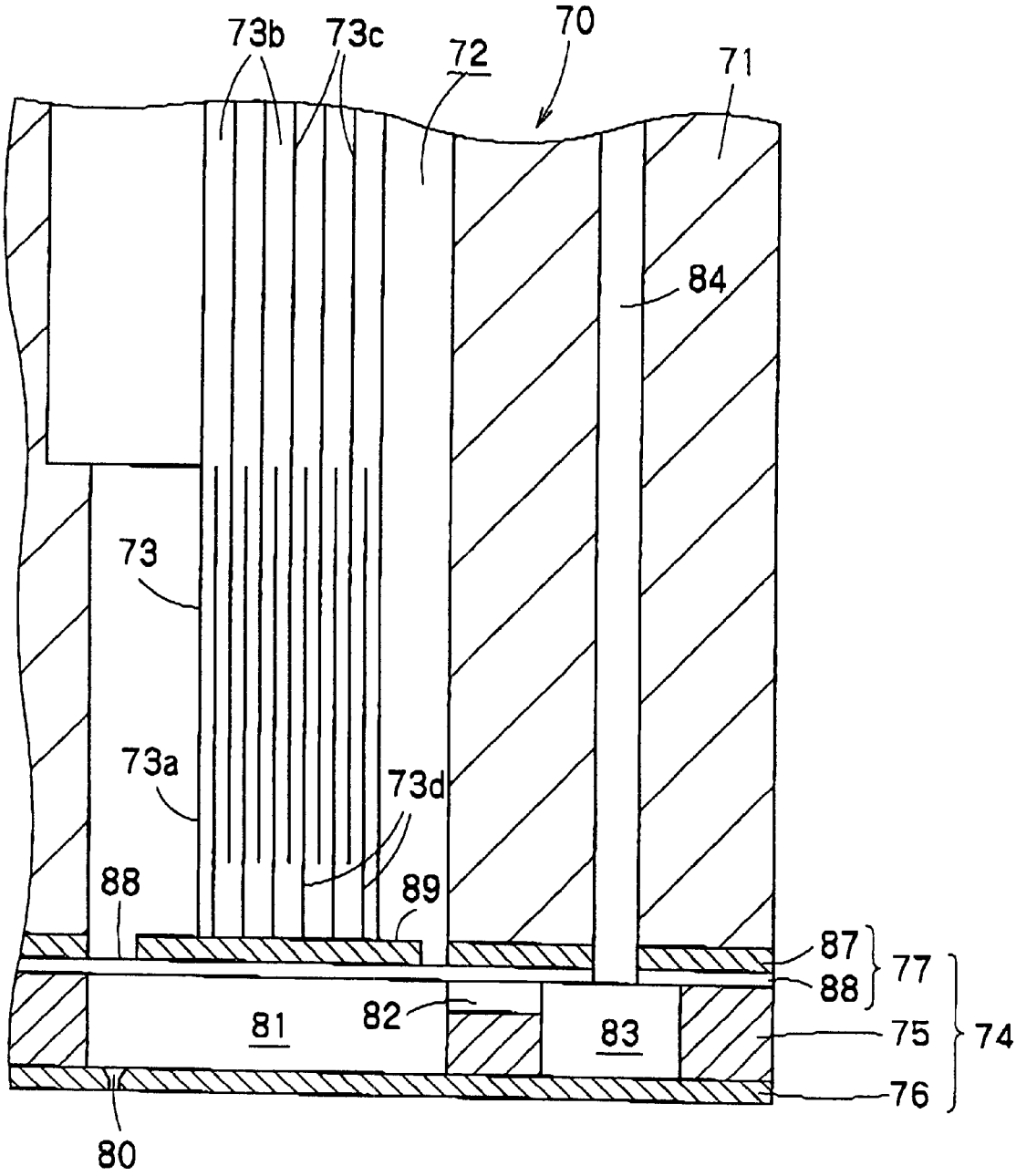
FIG. 10 is a sectional view of a recording head including a longitudinal-mode piezoelectric vibrating member.

As shown in FIG. 10, the recording head 70 has a plastic box-like case 71 defining a housing room 72. The longitudinal-mode piezoelectric vibrating unit 73 has a shape of teeth of a comb, and is inserted in the housing room 72 in such a manner that points of teeth-like portions 73*a* of the piezoelectric vibrating unit 73 are aligned at an opening of the housing room 72. A ink-way unit 74 is bonded on a surface of the case 71 on the side of the opening of the housing room 72. The points of the teeth-like portions 73*a* are fixed at predetermined positions of the ink-way unit 74 to function as piezoelectric vibrating members respectively.

The piezoelectric vibrating unit 73 comprises a plurality of piezoelectric layers 73*b*. As shown in FIG. 10, common inside electrodes 73*c* and individual inside electrodes 73*d* are inserted alternately between each adjacent two of the piezoelectric layers 73*b*. The piezoelectric layers 73*b*, the common inside electrodes 73*c* and the individual inside electrodes 73*d* are integrated and cut into the shape of the teeth of the comb. Thus, when a voltage is provided between the common inside electrodes 73*c* and an individual inside electrode 73*d*, a piezoelectric vibrating member contracts in a longitudinal direction of each of the piezoelectric layers 73*b*.

The ink-way unit 74 consists of a nozzle plate 76, an elastic plate 77 and an ink-way forming plate 75 sandwiched between the nozzle plate 76 and the elastic plate 77. The nozzle plate 76, the ink-way forming plate 75 and the elastic plate 77 are integrated as shown in FIG. 10.

A plurality of nozzles 80 is formed in the nozzle plate 76. A plurality of pressure generating chambers 81, a plurality of ink-supplying ways 82 and a common ink-chamber 83 are formed in the ink-way forming plate 75. Each of the pressure chambers 81 is defined by partition walls, and is communicated with a corresponding nozzle 80 at an end portion thereof and with a corresponding ink-supplying way 82 at the other end portion thereof. The common ink-chamber 83 is communicated with all the ink-supplying ways 82, and has a longitudinal shape. For example, the longitudinal common ink-chamber 83 may be formed by an etching process when the ink-way forming plate 75 is a silicon wafer. Then, the pressure chambers 81 are formed in the longitudinal direction of the common ink-chamber 83 at the same intervals (pitches) as nozzles 80. Then, a groove as a ink-supplying way 82 is formed between each of the pressure chambers 81 and the common ink-chamber 83. In the case, the ink-supplying way 82 is connected to an end of the pressure chamber 81, while the nozzle 80 is located near the other end of the pressure chamber 81. The common ink-chamber 83 is adapted to supply ink saved in an ink cartridge to the pressure chambers 81. An ink-supplying tube 84 from the ink cartridge is communicated with a middle portion of the common ink-chamber 83.

The elastic plate 77 is layered on a surface of the ink-way forming plate 75 opposed to the nozzle plate 76. In the case, the elastic plate 77 consists of two laminated layers that are a stainless plate 87 and an elastic high-polymer film 88 such as a PPS film. The stainless plate 77 is provided with island portions 89 for fixing the teeth-like portions 73*a* as the piezoelectric vibrating members 73 in respective portions corresponding to the pressure chambers 81, by an etching process.

In the above recording head 70, a teeth-like portion 73*a* as a piezoelectric vibrating member can expand in the longitudinal direction. Then, an island portion 89 is pressed toward the nozzle plate 76, the elastic film 88 is deformed. Thus, a corresponding pressure chamber 81 contracts. On the other hand, the teeth-like portion 73*a* as the piezoelectric vibrating member can contract from the expanding state in the longitudinal direction. Then, the elastic film 88 is returned to the original state owing to elasticity thereof. Thus, the corresponding pressure chamber 81 expands. By causing the pressure chamber 81 to expand and then causing the pressure chamber 81 to contract, a pressure of the ink in the pressure chamber 81 increases so that the ink drop is jetted from a nozzle 80.

In the recording head 70 as well, the menisci can minutely vibrate in such a manner that the ink drop may not be jetted, in order to stir the ink in the nozzles, by expanding and contracting of the piezoelectric vibrating members.

By the way, in the embodiment, the scanning-position-information outputting-information unit consists of the linear encoder 27 and the slit detector 29. In addition, the recording-starting-position-information setting unit, the micro-vibrating-starting-position-information setting unit and the micro-vibrating-starting-timing judging unit are adapted to set or judge the recording-starting-position information, the micro-vibrating-starting-position information and the micro-vibrating-starting-timing by means of the counting value corresponding to the detecting signals outputted from the slit detector 29. In the case, the scanning position of the recording head 8 may be surely obtained.

However, this invention can adopt another scanning-position-information outputting unit. For example, if a pattern of the scanning speed of the recording head 8 is fixed regardless of the dot-pattern-data, that is, if the recording head 8 is moved by the same scanning speed pattern, the scanning position of the recording head 8 can be obtained indirectly from a time passed from when the recording head has started scanning.

In the case, the scanning-position-information outputting unit may consist of a scanning-time timer 101 (first-scanning-time timer) for measuring a time passed from a scanning-starting timing (t1). The scanning position of the recording head 8 can be obtained from a timer value of the scanning-time timer 101, because the timer value corresponds to the head-position information.

In the case, the recording-starting-position-information setting unit may set a timer value for the recording-starting-position, that corresponds to the recording-starting-position information. Similarly, the micro-vibrating-starting-position-information setting unit may set a timer value for the micro-vibrating-starting-position, that corresponds to the micro-vibrating-starting-position information.

The micro-vibrating-starting-timing judging unit judges the micro-vibrating-starting timing by comparing the timer value of the scanning-time timer 101 with the timer value for the micro-vibrating-starting-position. Similarly, the recording-starting-timing judging unit judges the record-starting timing by comparing the timer value of the scanning-time timer 101 with the timer value for the recording-starting-position.

As described above, when the scanning position of the recording head 8 can be obtained from the timer value of the scanning-time timer 101, it is not necessary to provide with the linear encoder 27 and the slit detector 29. Thus, the apparatus may become simpler. In addition, the controlling part 6 does not have to watch the detecting signals from the slit detector 29. Thus, the controlling manner may also become simpler, and the processing speed may become faster.

The scanning-time timer 101 is adapted to measure a time passed from when the recording head 8 has started scanning. However, another scanning-time timer 102 (a second-scanning-time timer) can measure a time passed from when the scanning speed of the recording head 8 has become constant. In the case, a standard-passing position is set at a position where the scanning speed of the recording head 8 should become constant, for example at an end position 18A (see FIG. 7) of the recording paper 18 on the side of the home position HP in the width direction. In addition, there is provided a passing sensor that can detect a passing of the recording head 8 above the standard-passing position. Then, the scanning-time timer 102 starts to measure the time based on a detecting signal of the passing sensor. In the case, since the scanning-time timer 102 starts to measure the time passed from when the scanning speed of the recording head 8 has become constant, the scanning position of the recording head 8 can be obtained more accurately.

However, the scanning-position-information outputting unit is not limited to the combination of the linear encoder 27 and the slit detector 29, the scanning-time timer 101, and the scanning-time timer 102. Any scanning-position-information outputting unit capable of outputting information that represents the scanning position of the recording head 8 may be adopted.

For example, when the carriage 21 is reciprocated in the main scanning direction by a ball-spline mechanism, a rotary encoder may be attached to a rotating shaft of the ball-spline mechanism in such a manner that the rotary encoder rotates together with the rotating shaft, and a slit detector may be provided for detecting slits of the rotary encoder. In the case, the recording-starting-position and the micro-vibrating-starting-position can be recognized from detecting signals from the slit detector.

In the embodiment, the controlling part 6 functioning as a micro-vibrating controlling unit is adapted to supply the operating signal generated by the operating-signal generating part 9 (the main signal generating part 11 and the micro-vibrating-signal generating part 12) to the recording head 8. However, another micro-vibrating controlling unit can be adopted.

In the embodiment, the recording-starting-position-information setting unit is adapted to set the recording-starting-position of the recording head 8 based on the dot-pattern data. However, data for setting the recording-starting-position are not limited to the dot-pattern-data. For example, the recording-starting-position may be set based on printing data (one kind of recording data) from the host computer, or based on intermediate data (one kind of recording data).

In the embodiment, the printer includes the recording head 8 having the pressure chambers 36 that can expand and contract by means of the piezoelectric vibrating members 35. However, this invention can also apply to a printer or a plotter including a bubble-jet recording head that can jet ink drop from a nozzle by changing a size of air bubble generated in a pressure chamber.

Figure 11:
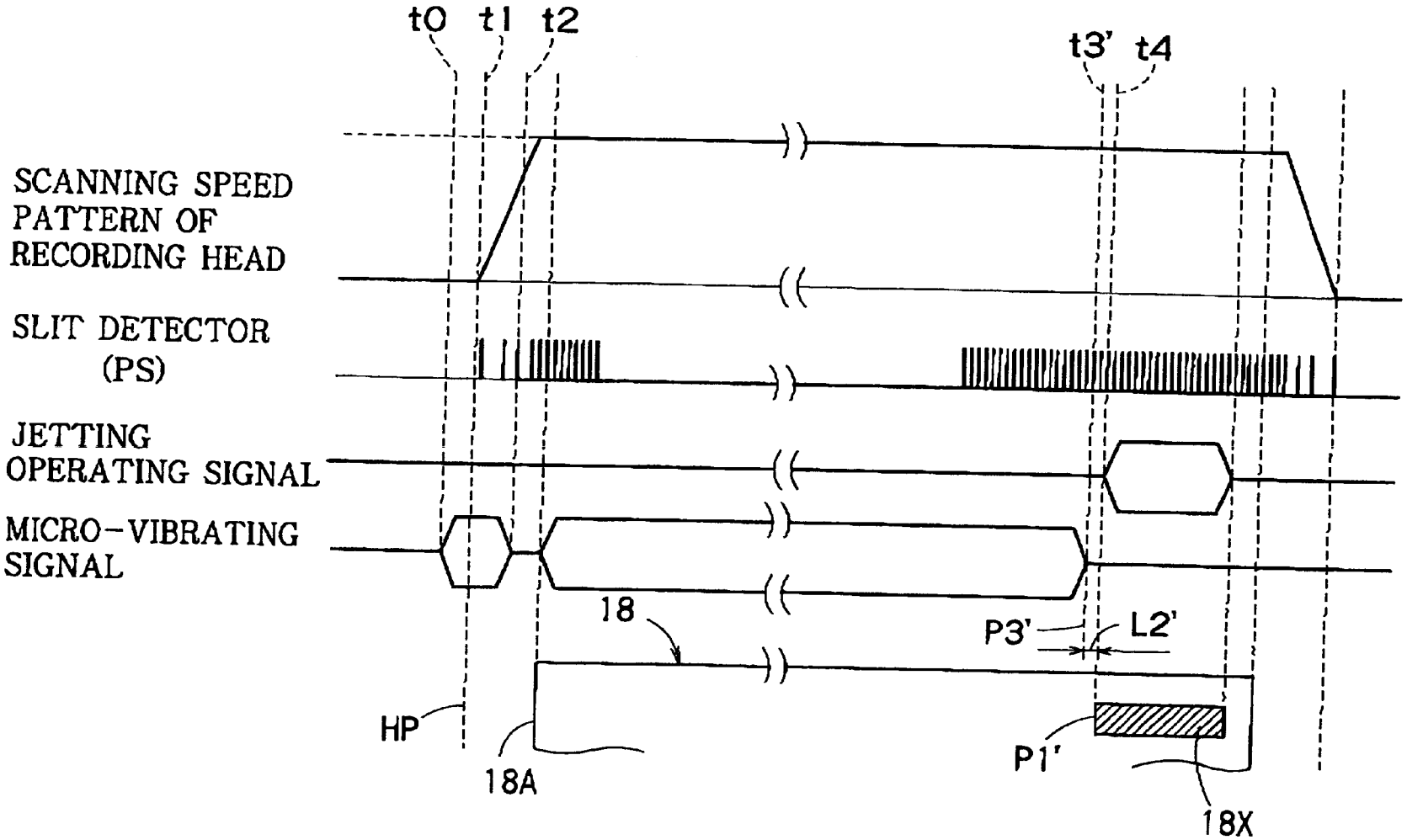
FIG. 11 is another timing chart for explaining a scanning operation including a recording operation for a line.

FIG. 11 is another timing chart for explaining a scanning operation including a recording operation for a line. As shown in FIG. 11, the controlling part 6 functions as a micro-vibrating-ceasing-position-information setting unit to set micro-vibrating-ceasing-position information that represents a position where the micro-vibrating unit should cease to cause the ink to minutely vibrate, for example just before starting the recording operation. For example, the micro-vibrating-ceasing-position is set at a position P3' back to the home position HP from the recording-starting-position P1' by a distance L2' that is necessary for the menisci to settle down after minutely vibrating. That is, the setting of the micro-vibrating-ceasing-position P3' is carried out based on the recording-starting-position information that has been set previously. Then, a counting value obtained by subtracting a counting value corresponding to the distance L2' from a counting value corresponding to the recording-starting-position P1' is set as a counting value corresponding to the micro-vibrating-ceasing-position P3'.

In the case shown in FIG. 11, the micro-vibrating-starting-position information is set at an end position 18A of the recording paper 18 on the side of the home position HP in the width direction, regardless of the recording-starting-position information. Of course, the micro-vibrating-starting-position in the case may be set based on the recording-starting-position information.

When the controlling part 6 judges that it is the pre-recording micro-vibrating-starting timing just before the recording operation, the controlling part 6 functions as a pre-recording micro-vibrating controlling unit (one kind of the micro-vibrating controlling unit) to supply a pre-recording micro-vibrating signal to the piezoelectric vibrating members 35 (S15: see FIG. 9A). That is, the controlling part 6 sets the printing data DV for the micro-vibrating operation in the shift register 55, and outputs the latch signals to the latch circuit 56 in order to start to supply the pre-recording micro-vibrating signal from the micro-vibrating-signal generating part 12 to the piezoelectric vibrating members 35 (see FIG. 6). On the other hand, the controlling part 6 sets the printing data DV' for the micro-vibrating stopping operation in the shift register 55, and outputs the latch signals at a predetermined stopping timing (t3') of the pre-recording micro-vibrating signal in order to cease to supply the pre-recording micro-vibrating signal to the piezoelectric vibrating members 35 (see FIG. 6). In the case, the predetermined stopping timing (t3') can be judged by comparing a counting value of the position counter with a predetermined counting value P3'.

As described above, according to the timing chart shown in FIG. 11, the menisci of the ink in the nozzle can be caused to minutely vibrate till a suitable timing (t3') just before an ink drop is jetted from a nozzle. To cause the menisci to keep minutely vibrating till the suitable timing is very effective when the ink consists of pigments whose viscosity is liable to increase.

In the embodiment, the recording-starting-position of the recording head 8 means a position where one of the nozzles of the recording head 8 starts to record, i.e., jet the ink. However, in general, the nozzles start to record at different positions respectively. Thus, it is preferable to take into consideration respective recording-starting-positions of the nozzles.

That is, preferably, the nozzles are classified into at least two classes, the controlling part 6 functioning as a recording-starting-position setting unit is adapted to set recording-starting-position information that represents positions where a nozzle or nozzles of the respective classes should start to record. Then, the controlling part 6 functioning as a micro-vibrating-starting-position setting unit may determine whether to cause the ink in the nozzle or the nozzles of the respective classes to minutely vibrate based on the recording-starting-position information, and may set micro-vibrating-starting-position information that represents respective positions where the micro-vibrating unit should start to cause the ink in the nozzle or the nozzles of the respective classes to minutely vibrate according to the recording-starting-position information if to cause the ink in the nozzle or the nozzles of the respective classes to minutely vibrate is determined. Then, the controlling part 6 functioning as a pre-recording micro-vibrating controlling unit may judge respective micro-vibrating-starting timings for the nozzle or the nozzles of the respective classes according to the micro-vibrating-starting-position information and the head-position information in order to cause the micro-vibrating unit to operate. The micro-vibrating unit may cause ink in the nozzle or nozzles of the respective classes to minutely vibrate.

In the case, when the class may includes a plurality of nozzles, ink in the nozzles of the class has preferably a velocity of increasing viscosity. Alternatively, when the class may includes a plurality of nozzles, ink in the nozzles of the class has a color. Alternatively, when the class may includes a plurality of nozzles, the nozzles of the class are arranged in a row. Alternatively, the class includes only one nozzle.

A program for materializing the above element or elements (unit or units) in the computer system, and a storage unit 201 storing the program and capable of being read by a computer, are intended to be protected by this application. When the above element or elements may be materialized in the computer system by using a general program such as an OS, a program including a command or commands for controlling the general program, and a storage unit 202 storing the program and capable of being read by a computer, are also intended to be protected by this application.

As described above, according to the invention, the menisci of the ink in the nozzles may minutely vibrate for a predetermined time from a suitable timing just before ink is jetted from the nozzles. Alternatively, according to the invention, the menisci of the ink in the nozzles may minutely vibrate till a suitable timing just before ink is jetted from the nozzles.

Thus, the viscosity of the ink in the nozzles may be returned at a normal level just before the ink is jetted. Therefore, the deterioration of the quality of the recorded image, especially at the portion where the printing operation has started, is effectively prevented even when the volume of the jetted ink is smaller or even when a large-sized recording paper is used as a recording medium.

When a class including a nozzle or nozzles that need a micro-vibrating operation is chosen, and only the meniscus or menisci of the ink in the nozzle or nozzles of the chosen class may be caused to minutely vibrate for a predetermined time from a suitable timing just before the ink drop or ink drops are jetted from the nozzle or nozzles of the class, the micro-vibrating operation may be carried out more efficiently.

In addition, when the scanning-position-information outputting unit has a linear encoder arranged in a main scanning direction of the recording head and provided with slits at minute intervals, and a slit detector movable in the main scanning direction together with the recording head and capable of detecting the slits, the scanning position of the recording head can be detected surely.

In addition, when the scanning-position-information outputting unit has a first-scanning-time timer for measuring a predetermined time from when the recording head has started scanning, the apparatus may become simpler, and the controlling manner may also become simpler.

In addition, the scanning-position-information outputting unit has a second-scanning-time timer for measuring a predetermined time from when a speed of the recording head during a scanning thereof has become constant, the scanning position of the recording head can be detected more accurately.

In addition, when the apparatus includes a thermometry unit for measuring a temperature of a surrounding of the recording head, and an operating voltage of the micro-vibrating unit can be changed according to the temperature measured by the thermometry unit, the ink at the openings of the nozzles may be stirred most suitably regardless of the environmental temperature.

What is claimed is:

1. An ink-jet recording apparatus comprising; a recording head having a nozzle, a micro-vibrating unit for causing ink in the nozzle to minutely vibrate, a recording-starting-position setting unit for setting recording-starting-position information that represents a position within the record range corresponding to the media where the nozzle should start to jet the ink, according to recording data, a micro-vibrating-starting-position setting unit for setting micro-vibrating-starting position information that represents a position where the micro-vibrating unit should start to cause the ink to minutely vibrate, according to the recording-starting-position information, a scanning-position-information outputting unit capable of outputting head-position information that represents a position of the recording head while the recording head is scanning, and a pre-recording micro-vibrating controlling unit for judging a micro-vibrating-starting timing according to the micro-vibrating-starting-position information and the head position information in order to cause the micro-vibrating unit to operate.

2. An ink-jet recording apparatus according to claim 1, wherein the scanning-position-information outputting unit has;

a linear encoder arranged along a main scanning direction of the recording head, provided with slits at minute intervals, and a slit detector movable along the main scanning direction together with the recording head, capable of detecting the slits.

3. An ink-jet recording apparatus according to claim 1, wherein the scanning-position-information outputting unit has;

a first-scanning-time timer for measuring a predetermined time from when the recording head has started scanning.

4. An ink-jet recording apparatus according to claim 1, wherein the scanning-position-information outputting unit has;

a second-scanning-time timer for measuring a predetermined time from when a speed of the recording head during a scanning thereof has become constant.

5. An ink-jet recording apparatus according to claim 1, further comprising;

a thermometry unit for measuring a temperature of a surrounding of the recording head, wherein:

an operating voltage of the micro-vibrating unit can be changed according to the temperature measured by the thermometry unit.

6. An ink-jet recording apparatus according to claim 1, further comprising;

a not-recording micro-vibrating controlling unit for judging whether the recording head is being accelerated according to the head-position information in order to cause the micro-vibrating unit to operate.

7. An ink-jet recording apparatus according to claim 6, wherein:

a signal generated by the pre-recording micro-vibrating controlling unit to cause the micro-vibrating unit to operate is identical with a signal generated by the not-recording micro-vibrating controlling unit to cause the micro-vibrating unit to operate.

8. An ink-jet recording apparatus according to claim 1, further comprising:

a mid-recording micro-vibrating controlling unit for causing the micro-vibrating unit to operate in such a manner that the micro-vibrating unit causes ink in a nozzle or nozzles not in a recording operation to minutely vibrate while at least another nozzle is in the recording operation.

9. An ink-jet recording apparatus comprising;

a recording head having a nozzle, a micro-vibrating unit for causing ink in the nozzle to minutely vibrate, a recording-starting-position setting unit for setting recording-starting-position information that represents a position where the nozzle should start to jet the ink, according to recording data, a micro-vibrating-ceasing-position setting unit for setting micro-vibrating-ceasing-position information that represents a position within the record range corresponding to the media where the micro-vibrating unit should cease to cause the ink to minutely vibrate, according to the recording-starting-position information, a scanning-position-information outputting unit capable of outputting head-position information that represents a position of the recording head while the recording head is scanning, and a pre-recording micro-vibrating controlling unit for judging a micro-vibrating-ceasing timing according to the micro-vibrating-ceasing-position information and the head position information in order to cause the micro-vibrating unit to stop.

10. An ink-jet recording apparatus according to claim 9, further comprising:

a mid-recording micro-vibrating controlling unit for causing the micro-vibrating unit to operate in such a manner that the micro-vibrating unit causes ink in a nozzle or nozzles not in a recording operation to minutely vibrate while at least another nozzle is in the recording operation.

11. An ink-jet recording apparatus comprising;

a recording head having a plurality of nozzles, the nozzles being classified into at least two classes, a micro-vibrating unit for causing ink in a nozzle or nozzles of a class to minutely vibrate, a recording-starting-position setting unit for setting recording-starting-position information that represents a position within the record range corresponding to the media where the nozzle or the nozzles of the class should start to jet the ink, according to recording data, a micro-vibrating-starting-position setting unit for determining whether to cause the ink in the nozzle or the nozzles of the class to minutely vibrate according to the recording-starting-position information, said micro-vibrating starting-position setting unit setting micro-vibrating starting-position information that represents a position where the micro-vibrating unit should start to cause the ink in the nozzle or the nozzles of the class to minutely vibrate according to the recording-starting-position information if to cause the ink in the nozzle or the nozzles of the class to minutely vibrate is determined, a scanning-position-information outputting unit capable of outputting head-position information that represents a position of the recording head while the recording head is scanning, and a pre-recording micro-vibrating controlling unit for judging a micro-vibrating-starting timing for the nozzle or the nozzles of the class according to the micro-vibrating starting-position information and the head-position information in order to cause the micro-vibrating unit to operate.

12. An ink-jet recording apparatus according to claim 3, further comprising;

a micro-vibrating-ceasing-position setting unit for setting micro-vibrating-ceasing-position information that represents a position where the micro-vibrating unit should cease to cause the ink in the nozzle or the nozzles of the class to minutely vibrate, according to the recording-starting-position information, wherein:

the pre-recording micro-vibrating controlling unit is adapted to judge a micro-vibrating-ceasing timing for the nozzle or the nozzles of the class according to the micro-vibrating-ceasing-position information and the head-position information in order to cause the micro-vibrating unit to stop.

13. An ink-jet recording apparatus according to claim 12, further comprising:

a mid-recording micro-vibrating controlling unit for causing the micro-vibrating unit to operate in such a manner that the micro-vibrating unit causes ink in a nozzle or nozzles not in a recording operation to minutely vibrate while at least another nozzle is in the recording operation.

14. An ink-jet recording apparatus according to claim 11, wherein:

the class includes a plurality of nozzles, and ink in the nozzles of the class has a velocity of increasing viscosity.

15. An ink-jet recording apparatus according to claim 11, wherein:

the class includes a plurality of nozzles, and ink in the nozzles of the class has a color.

16. An ink-jet recording apparatus according to claim 11, wherein:

the class includes a plurality of nozzles, and the nozzles of the class are arranged in a row.

17. An ink-jet recording apparatus according to claim 11, wherein:

the class includes only one nozzle.

18. An ink-jet recording apparatus according to claim 11, further comprising:

a mid-recording micro-vibrating controlling unit for causing the micro-vibrating unit to operate in such a manner that the micro-vibrating unit causes ink in a nozzle or nozzles not in a recording operation to minutely vibrate while at least another nozzle is in the recording operation.

19. A method for using an ink-jet recording apparatus including;

a recording head having a nozzle, a micro-vibrating unit for causing ink in the nozzle to minutely vibrate, a recording-starting-position setting unit for setting printing-starting-position information that represents a position within the record range corresponding to the media where the nozzle should start to jet the ink, according to recording data, a micro-vibrating-starting-position setting unit for setting micro-vibrating-starting position information that represents a position where the micro-vibrating unit should start to cause the ink to minutely vibrate, according to the recording-starting-position information, a scanning-position information outputting unit capable of outputting head-position information that represents a position of the recording head while the recording head is scanning, and a pre-recording micro-vibrating controlling unit for judging a micro-vibrating-starting timing according to the micro-vibrating-starting-position information and the head-position information in order to cause the micro-vibrating unit to operate, comprising;

a step of setting the micro-vibrating-starting-position information that represents the position where the micro-vibrating unit should start to cause the ink to minutely vibrate, according to the recording-starting-position information set by the recording-starting-position setting unit, and a step of causing the micro-vibrating unit to operate by the pre-recording micro-vibrating controlling unit, according to the micro-vibrating-starting-position information and the head-position information.

20. A method according to claim 19, wherein:

the ink-jet recording apparatus further includes a thermometry unit for measuring a temperature of a surrounding of the recording head, the method further includes a step of changing an operating voltage of the micro-vibrating unit according to the temperature measured by the thermometry unit.

21. A method according to claim 19, wherein:

the ink-jet recording apparatus further includes a not-recording micro-vibrating controlling unit for judging whether the recording head is being accelerated according to the head-position information in order to cause the micro-vibrating unit to operate.

22. A method according to claim 21, wherein:

a signal generated by the pre-recording micro-vibrating controlling unit to cause the micro-vibrating unit to operate is identical with a signal generated by the not-recorded micro-vibrating controlling unit to cause the micro-vibrating unit to operate.

23. A method according to claim 19, further comprising;

a step of causing the micro-vibrating unit to operate in such a manner that the micro-vibrating unit causes ink in a nozzle or nozzles not in a recording operation to minutely vibrate while at least another nozzle is in the recording operation.

24. A method for using an ink-jet recording apparatus including;

a recording head having a nozzle, a micro-vibrating unit for causing ink in the nozzle to minutely vibrate, a recording-starting-position setting unit for setting printing-starting-position information that represents a position within the record range corresponding to the media where the nozzle should start to jet the ink, according to recording data, a micro-vibrating-ceasing -position setting unit for setting micro-vibrating-ceasing-position information that represents a position where the micro-vibrating unit should cease to cause the ink to minutely vibrate, according to the recording-starting-position information, a scanning-position-information outputting unit capable of outputting head-position information that represents a position of the recording head while the recording head is scanning, and a pre-recording micro-vibrating controlling unit for judging a micro-vibrating-ceasing timing according to the micro-vibrating-ceasing-position information and the head-position information in order to cause the micro-vibrating unit to stop, comprising;

a step of setting the micro-vibrating-ceasing-position information that represents the position where the micro-vibrating unit should cease to cause the ink to minutely vibrate, according to the recording-starting-position information set by the recording-starting-position setting unit, and a step of causing the micro-vibrating unit to stop by the pre-recording micro-vibrating controlling unit, according to the micro-vibrating-ceasing-position information and the head position information.

25. A method according to claim 24, further comprising;

a step of causing the micro-vibrating unit to operate in such a manner that the micro-vibrating unit causes ink in a nozzle or nozzles not in a recording operation to minutely vibrate while at least another nozzle is in the recording operation.

26. A method for using an ink-jet recording apparatus including;

a recording head having a plurality of nozzles, the nozzles being classified into at least two classes, a micro-vibrating unit for causing ink in a nozzle or nozzles of a class to minutely vibrate, a recording-starting-position setting unit for setting recording-starting-position information that represents a position where the nozzle or the nozzles of the class should start within the record range corresponding to the media to jet the ink, a micro-vibrating-starting-position setting unit for determining whether to cause the ink in the nozzle or the nozzles of the class to minutely vibrate according to the recording starting-position information, said micro-vibrating starting-position setting unit setting micro-vibrating starting-position information that represents a position where the micro-vibrating unit should start to cause the ink in the nozzle or the nozzles of the class to minutely vibrate according to the recording-starting-position information if to cause the ink in the nozzle or the nozzles of the class to minutely vibrate is determined, a scanning-position-information outputting unit capable of outputting head-position information that represents a portion of the recording head while the recording head is scanning, and a pre-recording micro-vibrating controlling unit for judging a micro-vibrating-starting timing for the nozzle or the nozzles of the class according to the micro-vibrating starting-position information and the head-position information in order to cause the micro-vibrating unit to operate, comprising;

a step of determining whether to cause the ink in the nozzle or the nozzles of the class to minutely vibrate according to the recording-starting-position information set by the recording-starting-position setting unit, and of setting the micro-vibrating-starting-position information that represents the position where the micro-vibrating unit should start to cause the ink in the nozzle or the nozzles of the class to minutely vibrate if to cause the ink in the nozzle or the nozzles of the class to minutely vibrate is determined, and a step of causing the micro-vibrating unit to operate by the pre-recording micro-vibrating controlling unit, according to the micro-vibrating-starting-position information and the head-position information.

27. A method according to claim 26, wherein:

the ink-jet recording apparatus further includes a micro-vibrating-ceasing-position setting unit for setting micro-vibrating-ceasing-position information that represents a position where the micro-vibrating unit should cease to cause the ink in the nozzle or the nozzles of the class to minutely vibrate, according to the recording-starting-position information, and the pre-recording micro-vibrating controlling unit is adapted to judge a micro-vibrating-ceasing timing for the nozzle or the nozzles of the class according to the micro-vibrating-ceasing-position information and the head-position information in order to cause the micro-vibrating unit to stop.

28. A method according to claim 27, further comprising;

a step of causing the micro-vibrating unit to operate in such a manner that the micro-vibrating unit causes ink in a nozzle or nozzles not in a recording operation to minutely vibrate while at least another nozzle is in the recording operation.

29. A method according to claim 26, further comprising;

a step of causing the micro-vibrating unit to operate in such a manner that the micro-vibrating unit causes ink in a nozzle or nozzles not in a recording operation to minutely vibrate while at least another nozzle is in the recording operation.

30. A controlling unit for controlling an ink-jet recording apparatus having: a recording head having a nozzle, and a micro-vibrating unit for causing ink in the nozzle to minutely vibrate, comprising;

a recording-starting-position setting unit for setting recording-starting-position information that represents a position within the record range corresponding to the media where the nozzle should start to jet the ink, according to recording data, a micro-vibrating-starting-position setting unit for setting micro-vibrating-starting-position information that represents a position where the micro-vibrating unit should start to cause the ink to minutely vibrate, according to the recording-starting-position information, a scanning-position-information outputting unit capable of outputting head-position information that represents a position of the recording head while the recording head is scanning, and a pre-recording micro-vibrating controlling unit for judging a micro-vibrating-starting timing according to the micro-vibrating-starting-position information and the head-position information in order to cause the micro-vibrating unit to operate.

31. A controlling unit according to claim 30, further comprising;

a thermometry unit for measuring a temperature of a surrounding of the recording head, wherein:

an operating voltage of the micro-vibrating unit can be changed according to the temperature measured by the thermometry unit.

32. A controlling unit according to claim 30, further comprising;

a not-recording micro-vibrating controlling unit for judging whether the recording head is being accelerated according to the head-position information in order to cause the micro-vibrating unit to operate.

33. A controlling unit according to claim 32, wherein:

a signal generated by the pre-recording micro-vibrating controlling unit to cause the micro-vibrating unit to operate is identical with a signal generated by the not-recording micro-vibrating controlling unit to cause the micro-vibrating unit to operate.

34. A controlling unit according to claim 30, further comprising:

a mid-recording micro-vibrating controlling unit for causing the micro-vibrating unit to operate in such a manner that the micro-vibrating unit causes ink in a nozzle or nozzles not in a recording operation to minutely vibrate while at least another nozzle is in the recording operation.

35. A controlling unit for controlling an ink-jet recording apparatus having:

a recording head having a nozzle, and a micro-vibrating unit for causing ink in the nozzle to minutely vibrate, comprising;

a recording-starting-position setting unit for setting recording-starting-position information that represents a position within the record range corresponding to the media where the nozzle should start to jet the ink, according to recording data, a micro-vibrating-ceasing-position setting unit for setting micro-vibrating-ceasing-position information that represents a position where the micro-vibrating unit should cease to cause the ink to minutely vibrate, according to the recording-starting-position information, a scanning-position-information outputting unit capable of outputting head-position information that represents a position of the recording head while the recording head is a pre-recording micro-vibrating controlling unit for judging a micro-vibrating-ceasing timing according to the micro-vibrating-ceasing-position information and the head position information in order to cause the micro-vibrating unit to stop.

36. A controlling unit according to claim 35, further comprising;

a thermometry unit for measuring a temperature of a surrounding of the recording head, wherein:

an operating voltage of the micro-vibrating unit can be changed according to the temperature measured by the thermometry unit.

37. A controlling unit according to claim 35, further comprising:

a not-recording micro-vibrating controlling unit for judging whether the recording head is being accelerated according to the head-position information in order to cause the micro-vibrating unit to operate.

38. A controlling unit according to claim 34, further comprising;

a not-recording micro-vibrating controlling unit for judging whether the recording head is being accelerated according to the head-position information in order to cause the micro-vibrating unit to operate.

39. A controlling unit according to claim 38, wherein:

a signal generated by the pre-recording micro-vibrating controlling unit to cause the micro-vibrating unit to operate is identical with a signal generated by the not-recording micro-vibrating controlling unit to cause the micro-vibrating unit to operate.

40. A controlling unit according to claim 37, wherein:

a signal generated by the pre-recording micro-vibrating controlling unit to cause the micro-vibrating unit to operate is identical with a signal generated by the not-recording micro-vibrating controlling unit to cause the micro-vibrating unit to operate.

41. A controlling unit according to claim 35, further comprising:

a mid-recording micro-vibrating controlling unit for causing the micro-vibrating unit to operate in such a manner that the micro-vibrating unit causes ink in a nozzle or nozzles not in a recording operation to minutely vibrate while at least another nozzle is in the recording operation.

42. A controlling unit for controlling an ink-jet recording apparatus having:

a recording head having a plurality of nozzles, the nozzles being classified into at least two classes, and a micro-vibrating unit for causing ink in a nozzle or nozzles of a class to minutely vibrate, comprising;

a recording-starting-position setting unit for setting recording-starting-position information that represents a position within the record range corresponding to the media where the nozzle or the nozzles of the class should start to jet the ink, according to recording data, a micro-vibrating-starting-position setting unit for determining whether to cause the ink in the nozzle or the nozzles of the class to minutely vibrate according to the recording-starting-position information, said micro-vibrating starting-position setting unit setting micro-vibrating starting-position information that represents a position where the micro-vibrating unit should start to cause the ink in the nozzle or the nozzles of the class to minutely vibrate according to the recording-starting-position information if to cause the ink in the nozzle or the nozzles of the class to minutely vibrate is determined, a scanning-position-information outputting unit capable of outputting head-position information that represents a position of the recording head while the recording head is scanning, and a pre-recording micro-vibrating controlling unit for judging a micro-vibrating-starting timing for the nozzle or the nozzles of the class according to the micro-vibrating starting-position information and the head-position information in order to cause the micro-vibrating unit to operate.

43. A controlling unit according to claim 42, further comprising;

a micro-vibrating-ceasing-position setting unit for setting micro-vibrating-ceasing-position information that represents a position where the micro-vibrating unit should cease to cause the ink in the nozzle or the nozzles of the class to minutely vibrate, according to the recording-starting-position information, wherein:

the pre-recording micro-vibrating controlling unit is adapted to judge a micro-vibrating-ceasing timing for the nozzle or the nozzles of the class according to the micro-vibrating-ceasing-position information and the head-position information in order to cause the micro-vibrating unit to stop.

44. A controlling unit according to claim 43, further comprising;

a thermometry unit for measuring a temperature of a surrounding of the recording head, wherein:

an operating voltage of the micro-vibrating unit can be changed according to the temperature measured by the thermometry unit.

45. A controlling unit according to claim 43, further comprising:

a mid-recording micro-vibrating controlling unit for causing the micro-vibrating unit to operate in such a manner that the micro-vibrating unit causes ink in a nozzle or nozzles not in a recording operation to minutely vibrate while at least another nozzle is in the recording operation.

46. A controlling unit according to claim 42, further comprising;

a thermometry unit for measuring a temperature of a surrounding of the recording head, wherein:

an operating voltage of the micro-vibrating unit can be changed according to the temperature measured by the thermometry unit.

47. A controlling unit according to claim 42, further comprising;

a not-recording micro-vibrating controlling unit for judging whether the recording head is being accelerated according to the head-position information in order to cause the micro-vibrating unit to operate.

48. A controlling unit according to claim 47, wherein:

a signal generated by the pre-recording micro-vibrating controlling unit to cause the micro-vibrating unit to operate is identical with a signal generated by the not-recording micro-vibrating controlling unit to cause the micro-vibrating unit to operate.

49. A controlling unit according to claim 42, further comprising:

a mid-recording micro-vibrating controlling unit for causing the micro-vibrating unit to operate in such a manner that the micro-vibrating unit causes ink in a nozzle or nozzles not in a recording operation to minutely vibrate while at least another nozzle is in the recording operation.

50. A storage unit capable of being read by a computer, storing a program for materializing a controlling unit for controlling an ink-jet recording apparatus having: a recording head having a nozzle, and a micro-vibrating unit for causing ink in the nozzle to minutely vibrate, said controlling unit comprising; a recording-starting-position setting unit for setting recording-starting-position information that represents a position within the record range corresponding to the media where the nozzle should start to jet the ink, according to recording data, a micro-vibrating-starting-position setting unit for setting micro-vibrating-starting-position information that represents a position where the micro-vibrating unit should start to cause the ink to minutely vibrate, according to the recording-starting-position information, a scanning-position-information outputting unit capable of outputting head-position information that represents a position of the recording head while the recording head is scanning, and a pre-recording micro-vibrating controlling unit for judging a micro-vibrating-starting timing according to the micro-vibrating-starting-position information and the head-position information in order to cause the micro-vibrating unit to operate.

51. A storage unit capable of being read by a computer, storing a program including a command for controlling a second program executed by a compute system including a computer, said program being executed by the computer system to control the second program to materialize a controlling unit for controlling an ink-jet recording apparatus having: a recording head having a nozzle, and micro-vibrating unit for causing ink in the nozzle to minutely vibrate, said controlling unit comprising: a recording-starting-position setting unit for setting recording-starting-position information that represents a position within the record range corresponding to the media where the nozzle should start to jet the ink, according to recording data, a micro-vibrating-starting-position setting unit for setting micro-vibrating-starting-position information that represents a position where the micro-vibrating unit should start to cause the inn to minutely vibrate, according to the recording-starting-position information, a scanning-position-information outputting unit capable of outputting head-position information that represents a position of the recording head while the recording head is scanning, and a pre-recording micro-vibrating controlling unit for judging a micro-vibrating-starting timing according to the micro-vibrating-starting-position information and the head-position information in order to cause the micro-vibrating unit to operate.

52. A storage unit capable of being read by a computer, storing a program for materializing a controlling unit for controlling an ink-jet recording apparatus having: a recording head having a nozzle, and a micro-vibrating unit for causing ink in the nozzle to minutely vibrate, said controlling unit comprising; a recording-starting-position setting unit for setting recording-starting-position information that represents a position where the nozzle should start to jet the ink, according to recording data, a micro-vibrating-ceasing-position setting unit for setting micro-vibrating-ceasing-position information that represents a position within the record range corresponding to the media where the micro-vibrating unit should cease to cause the ink to minutely vibrate, according to the recording-starting-position information, a scanning-position-information outputting unit capable of outputting head-position information that represents a position of the recording head while the recording head is scanning, and a pre-recording micro-vibrating controlling unit for judging a micro-vibrating-ceasing timing according to the micro-vibrating-ceasing-position information and the head-position in order to cause the micro-vibrating unit to stop.

53. A storage unit capable of being read by a computer, storing a program including a command for controlling a second program executed by a computer system including a computer, said program being executed by the computer system to control the second program to materialize a controlling unit for controlling an ink-jet recording apparatus having: a recording head heaving a nozzle, and a micro-vibrating unit for causing ink in the nozzle to minutely vibrate, said controlling unit comprising: a recording-starting-position setting unit for setting recording-starting-position information that represents a position within the record range corresponding to the media where the nozzle should start to jet the ink, according to recording data, a micro-vibrating-ceasing-position setting unit for setting micro-vibrating-ceasing-position information that represents a position where the micro-vibrating unit should cease to cause the ink to minutely vibrate, according to the recording-starting-position information, a scanning-position-information outputting unit capable of outputting head-position information that represents a position of the recording head while the recording head is scanning, and a pre-recording micro-vibrating controlling unit for judging a micro-vibrating-ceasing timing according to the micro-vibrating-ceasing-position information and the head-position information in order to cause the micro-vibrating unit to stop.

54. A storage unit capable of being read by a computer, storing a program for materializing a controlling unit for controlling an ink-jet recording apparatus having: a recording head having a plurality of nozzles, the nozzles being classified into at least two classes, and a micro-vibrating unit for causing ink in a nozzle or nozzles of a class to minutely vibrate, said controlling unit comprising; a recording-starting-position setting unit for setting recording-starting-position information that represents a position within the record range corresponding to the media where the nozzle or the nozzles of the class should start to jet the ink, according to recording data, a micro-vibrating-staring-position setting unit for determining whether to cause the ink in the nozzle or the nozzles of the class to minutely Vibrate according to the recording-starting-position information, said micro-vibrating-starting-position setting unit setting micro-vibrating-starting-position information that represents a position where the micro-vibrating unit should start to cause the ink in the nozzle or the nozzles of the class to minutely vibrate according to the recording-starting-position information if to cause the ink in the nozzle or the nozzles of the class to minutely vibrate is determined, a scanning-position-information outputting unit capable of outputting head-position information that represents a position of the recording head while the recording head is scanning, and a pre-recording micro-vibrating controlling unit for judging a micro-vibrating-starting timing for the nozzle or the nozzles of the class according to the micro-vibrating-starting-position information and the head-position information in order to cause the micro-vibrating unit to operate.

55. A storage unit capable of being read by a computer, storing a program including a command for controlling a second program executed by a computer system including a computer, said program being executed by the computer system to control the second program to materialize a controlling unit for controlling an ink-jet recording apparatus having: a recording head having a plurality of nozzles, the nozzles being classified into at least two classes, and a micro-vibrating unit for causing ink in a nozzle or nozzles of a class to minutely vibrate, said controlling unit comprising; a recording-starting-position setting unit for setting recording-starting-position information that represents a position within the record range corresponding to the media where the nozzle or the nozzles of the class should start to jet the ink, according to recording data, a micro-vibrating-starting-position setting unit for determining whether to cause the ink in the nozzle or the nozzles of the class to minutely vibrate according to the recording-starting-position information, said micro-vibrating-starting-position setting unit setting micro-vibrating-starting-position information that represents a position where the micro-vibrating unit should start to cause the ink in the nozzle or the nozzles of the class to minutely vibrate according to the recording-starting-position information if to cause the ink in the nozzle oar the nozzles of the class to minutely vibrate is determined, a scanning-position-information outputting unit capable of outputting head-position information that represents a position of the recording head while the recording head is scanning, and a pre-recording micro-vibrating controlling unit for judging a micro-vibrating-starting timing for the nozzle or the nozzles of the class according to the micro-vibrating-starting-position information and the head-position information in order to cause the micro-vibrating unit to operate.

56. A storage unit capable of being read by a computer, storing a program for materializing a controlling unit for controlling an ink-jet recording apparatus having: a recording head having a plurality of nozzles, the nozzles being classified into at least two classes, a micro-vibrating unit for causing ink in a nozzle or nozzles of a class to minutely vibrate, said controlling unit comprising; a recording-starting-position setting unit for setting recording-starting-position information that represents a position where the nozzle or the nozzles of the class should start to jet the ink, according to recording data, a micro-vibrating-starting-position setting unit for determining whether to cause the ink in the nozzle or the nozzles of the class to minutely vibrate according to the recording-starting-position information, said micro-vibrating-starting-position setting unit setting micro-vibrating-starting-position information that represents a position within the record range corresponding to the media where the micro-vibrating unit should start to cause the ink in the nozzle or the nozzles of the class to minutely vibrate according to the recording-starting-position information if to cause the ink in the nozzle or the nozzles of the class to minutely vibrate is determined, a scanning-position-information outputting unit capable of outputting head-position information that represents a position of the recording head while the recording head is scanning, a pre-recording micro-vibrating controlling unit for judging a micro-vibrating-starting timing for the nozzle of the nozzles of the class according to the micro-vibrating-starting-position information and the head-position information in order to cause the micro-vibrating unit to operate, and a micro-vibrating-ceasing-position setting unit for setting micro-vibrating-ceasing-position information that represents a position where the micro-vibrating unit should cease to cause the ink in the nozzle or the nozzles of the class to minutely vibrate, according to the recording-starting-position information, the pre-recording micro-vibrating controlling unit being adapted to judge a micro-vibrating-ceasing timing for the nozzle or the nozzles of the class according to the micro-vibrating-ceasing-position information and the head-position information in order to cause the micro-vibrating unit to stop.

57. A storage unit capable of being read by a computer, storing a program including a command for controlling a second program executed by a computer system including a computer, said program being executed by the computer system to control the second program to materialize a controlling unit for controlling an ink-jet recording apparatus having: a recording head having a plurality of nozzles, the nozzles being classified into at least two classes, and a micro-vibrating unit for causing ink in a nozzle or nozzles of a class to minutely vibrate, said controlling unit comprising; a recording-starting-position setting unit for setting recording-starting-position information that represents a position within the record range corresponding to the media where the nozzle or the nozzles of the class should start to jet the ink, according to recording data, a micro-vibrating-starting-position setting unit for determining whether to cause the ink in the nozzle or the nozzles of the class to minutely vibrate according to the recording-starting-position information, said micro-vibrating-starting-position setting unit setting micro-vibrating-starting-position information that represents a position where the micro-vibrating unit should start to cause the ink in the nozzle or the nozzles of the class to minutely vibrate according to the recording-starting-position information if to cause the ink in the nozzle or the nozzles of the class to minutely vibrate is determined, a scanning-position-information outputting unit capable of outputting head-position information that represents a position of the recording head while the recording head is scanning, a prerecording micro-vibrating controlling unit for judging a micro-vibrating-starting timing for the nozzle or the nozzles of the class according to the micro-vibrating-starting-position information and the head-position information in order to cause the micro-vibrating unit to operate, and a micro-vibrating-ceasing-position setting unit for setting micro-vibrating-ceasing-position information that represents a position where the micro-vibrating unit should cease to cause the ink in the nozzle or the nozzles of the class to minutely vibrate, according to the recording-starting-position information, the pre-recording micro-vibrating controlling unit being adapted to judge a micro-vibrating-ceasing timing for the nozzle or the nozzles of the class according to the micro-vibrating-ceasing-position information and the head-position information in order to cause the micro-vibrating unit to stop.

* * * * *